US005478061A

United States Patent [19]

Murakami et al.

[11] Patent Number: 5,478,061

[45] Date of Patent: Dec. 26, 1995

[54] SHEET POST-PROCESSING APPARATUS

[75] Inventors: Susumu Murakami, Ikoma; Toshiya Mikita, Osaka; Koji Katamoto, Yamatokoriyama; Naoya Okamura, Nara; Tomonori Ohata, Nara; Kazuya Hamaguchi, Nara, all of Japan

[73] Assignee: Sharp Kabushiki Kaisha, Osaka, Japan

[21] Appl. No.: 266,340

[22] Filed: Jul. 1, 1994

[30] Foreign Application Priority Data

Aug. 6, 1993 [JP] Japan ..... 5-196288

[51] Int. Cl.[6] ..... B42B 2/00; B65H 31/00; B65H 39/10

[52] U.S. Cl. ..... 270/53; 271/207; 271/208; 271/303

[58] Field of Search ..... 270/53; 355/324; 271/207, 208, 303

[56] References Cited

U.S. PATENT DOCUMENTS

| | | | |
|---|---|---|---|
| 4,339,119 | 7/1982 | Sasaki et al. | 271/180 |
| 4,842,264 | 6/1989 | Kosaka et al. | 271/293 |
| 4,951,935 | 8/1990 | Oikawa | 271/208 |
| 5,013,021 | 5/1991 | Johdai et al. . | |
| 5,021,837 | 6/1991 | Uto et al. | 270/53 X |
| 5,098,074 | 3/1992 | Mandel et al. | 270/53 |
| 5,137,265 | 8/1992 | Sato et al. | 270/53 |
| 5,183,249 | 2/1993 | Ichikawa | 271/303 X |
| 5,190,274 | 3/1993 | Kamamoto et al. | 270/53 |
| 5,201,517 | 4/1993 | Stemmle | 270/53 X |
| 5,215,298 | 6/1993 | Stemmle et al. | 271/207 X |
| 5,288,062 | 2/1994 | Rizzolo et al. | 270/53 |
| 5,320,336 | 6/1994 | Asami | 270/53 X |
| 5,344,130 | 9/1994 | Suzuki et al. | 270/53 |
| 5,346,203 | 9/1994 | Stemmle | 270/53 X |
| 5,385,340 | 1/1995 | Hiroi et al. | 270/53 |
| 5,398,918 | 3/1995 | Rizzolo et al. | 270/53 |

FOREIGN PATENT DOCUMENTS

| | | | |
|---|---|---|---|
| 0346851 | 12/1989 | European Pat. Off. . | |
| 0371403 | 6/1990 | European Pat. Off. . | |
| 0548566 | 6/1993 | European Pat. Off. . | |
| 59-007659 | 1/1984 | Japan . | |
| 63-106254 | 5/1988 | Japan . | |
| 5-147815 | 6/1993 | Japan . | |
| 5-147372 | 6/1993 | Japan | 270/53 |

*Primary Examiner*—John E. Ryzinc

[57] ABSTRACT

A sheet post-processing apparatus is arranged such that in the non-staple mode, the leading edges of the sheets transported from the transport rollers are directed so as to be sandwiched between the upper and lower discharge rollers by a movable sheet guide in a non-staple mode position and the sheets are discharged onto a stacking tray through the upper and lower discharge rollers. In the staple mode, the leading edges of the sheets is directed to a discharge opening formed between the upper discharge roller and the movable sheet guide by the movable sheet guide in the staple mode position so as to be dropped onto the staple tray. After being processed by the stapler, the sheets are pushed by a pushing member through the discharge opening onto the stacking tray. As a result, the movements of the upper and lower discharge rollers are stabilized, and the sheets can be prevented from being stuck between the upper and lower discharge rollers and or being slanted when being discharged, thereby achieving a desirable discharge of the sheets in the non-staple mode.

20 Claims, 31 Drawing Sheets

SHEET POST-PROCESSING APPARATUS

FIELD OF THE INVENTION

The present invention relates to a sheet post-processing apparatus, for use in combination with an image forming apparatus such as a copying machine, a laser printer, etc., more particularly relates to a sheet post-processing apparatus with a finishing function which enables sheets transported from the image forming apparatus to be processed, for example, by stapling.

BACKGROUND OF THE INVENTION

Recently, many copying machines are combined with sheet post-processing apparatuses with post-processing functions such as binding or punching sheets having images copied thereon in order to automate the process.

For the conventional sheet post-processing apparatuses, for example, European Patent No. 346,851 discloses a sheet post-processing apparatus wherein an endless transport belt is driven in one direction, and stapled sheets are discharged from a processing tray onto a stacking tray by a push-out member provided on the transport belt. In the above apparatus, the stacking tray can be raised and lowered so that the top surface of the sheets stacked on the stacking tray is set at virtually the same height as the processing tray.

Another conventional sheet post-processing apparatus is known as disclosed in European Patent No. 371,403 wherein a stacking tray can be moved vertically and horizontally, sheets are placed over the stacking tray and the processing tray, and after a cycle of copying process is completed, a set of sheets is stapled and discharged onto the stacking tray using a discharge roller and swinging roller or using an ejector. In the non-processing mode, the swinging roller is brought in contact with the discharge roller, and sheets fed from the copying machine main body are discharged onto the stacking tray, while in the processing mode, the swinging roller is kept apart from the discharge roller, and sheets fed from the copying machine main body are temporarily stored on the processing tray, thereafter, the swinging roller is brought in contact with the discharge roller so as to discharge the sheets onto the stacking tray.

U.S. Pat. No. 5,137,265 discloses a sheet post-processing apparatus wherein a recessed portion on the stacking tray corresponds to a needle for fastening the sheets in the processing mode, The above apparatus is also arranged such that in the processing mode, when transporting sheets which are larger than a predetermined size, the sheets placed over the processing tray and the stacking tray are discharged onto the stacking tray by the discharge roller and the swinging roller, while when transporting sheets which are smaller than a predetermined size, sheets remain placed over the post-processing tray and the stacking tray without being discharged. Additionally, in the processing mode, an auxiliary tray is moved to place the stacking tray on an extended line of the processing tray so as to discharge a processed set of sheets onto the stacking tray from the processing tray.

A still another conventional sheet post-processing apparatus is disclosed in Japanese Laid Open Patent Application No. 147815/1993 (Tokukaihei 5-147815) wherein among copy sheets conveyed from the main body of the copying machine, sheets not to be processed are directly discharged onto a stacking tray, while sheets to be processed are supported on the processing tray, and after being processed, a processed set of sheets is discharged onto the stacking tray by the pushing member. The above described sheet post-processing apparatus will be explained below with reference to simplified structure shown in FIG. 32 and FIG. 33.

In the non-processing mode, in which sheets are not processed, a sheet P discharged from a copying machine main body (not shown) is transported into the apparatus through sheet guides 101 and 102 as shown in FIG. 32. Then, the sheet P is further transported to a discharge roller 106 by transport rollers 103 and 104. Thereafter, the sheet P passes between the discharge roller 106 and a pressure roller 105 to be pressed onto the discharge roller 106, thereby discharging the sheet P onto a stacking tray 107 by a transporting force.

On the other hand, in the processing mode in which, for example, sheets are stapled, as shown in FIG. 33, the pressure roller 105 is moved upward together with a sheet guide 108, and an opening of a discharge section 109 is formed between the pressure roller 105 and the discharge roller 106. In this state, the sheet P transported by the transport rollers 103 and 104 is dropped onto a slanted processing tray 110 when it becomes apart from the transport rollers 103 and 104. The movement of the sheet P is supported by a rotary vane 112 made of a rubber being rotated in a direction of A until the sheet P reaches a member 111 for stopping the trailing edge of the sheets P. Then, the sheets P are aligned in a widthwise direction by an aligner plate 113 which is driven in a widthwise direction. When a predetermined number of sheets P are placed on the processing tray 110 after repeating the above process, a stapling process is carried out on the sheets placed on the processing tray 110 by the stapler 114. Thereafter, with the movement of the sheet push-out member 115 in a direction of C, the sheets P on the processing tray 110 are discharged onto the stacking tray 107 through the discharge section 109.

In the above conventional sheet post-processing apparatus, however, the pressure roller 105, which transports the sheet P together with the discharge roller 106, presses the discharge roller 106 in the non-processing mode, while in the processing mode, the pressure roller 105 becomes apart from the discharge roller 106. Namely, the contacting state between the pressure roller 105 and the discharge roller 106 and a distance between the discharge roller 106 and the pressure roller 105 change between the non-processing mode and the processing mode. Thus, the pressure roller 105 cannot be pressed onto the discharge roller 106 in a stable condition, thereby presenting the problem that a sheet may be stuck or slanted when being discharged in the non-processing mode.

SUMMARY OF THE INVENTION

An object of the present invention is to provide a sheet post-processing apparatus for use in combination with, for example, a copying machine, which enables sheets to be prevented from being stuck or slanted when being discharged due to a difference in the contact state of discharge rollers between a non-processing mode and a processing mode.

In order to achieve the above object, the first sheet post-processing apparatus of the present invention is characterized by including:

- sheet transport means for transporting sheets from an external section into the apparatus;
- a processing tray for placing thereon sheets to be processed;
- a stacking tray for placing thereon sheets discharged from the apparatus;

sheet processing means such as a stapler for processing the sheets on the processing tray first discharge means for discharging onto the stacking tray a set of sheets processed by the sheet processing means through a processed set discharge section;

second discharge means such as upper and lower discharge rollers for discharging sheets onto the stacking tray, the second discharge means being provided at a portion on a sheet discharge side of the stacking tray;

a sheet guide member for guiding leading edges of the sheets transported by the sheet transport means to the processed set discharge section, the sheet guide member being capable of selectively .moving between a processing mode position for dropping the sheets onto the processing tray and a non-processing mode position for guiding the leading edges of the sheets to the second discharge means, the sheet guide member forming an opening of the processed set discharge section vertically above the second discharge means when the sheet guide member is moved to the processing mode position;

sheet guide member drive means for driving the sheet guide member; and control means for controlling the sheet guide member drive means such that the sheet guide member is placed in the processing mode position when the processing mode is selected, while in the non-processing mode position when the non-processing mode is selected.

According to the above arrangement of the first sheet post-processing apparatus, in the processing mode, sheets fed into the apparatus by the sheet transport means are guided by the sheet guide member placed in the processing mode position, and after the leading edge thereof is transported to an opening of the processed set discharge section formed vertically above the second discharge means, the sheets are dropped onto the processing tray. The sheets thus placed on the processing tray are processed by the processing means, and then discharged onto the stacking tray through the processed set discharge section by the first discharge means.

While in the non-processing mode, the sheets transported into the apparatus are guided by the sheet guide member placed in the non-processing mode position, and after being transported to the second discharge means, the sheets are discharged onto the stacking tray by the second discharge means.

As described, in the first sheet post-processing apparatus of the present invention, respective transport paths for use in discharging the sheets in the processing mode and non-processing mode cross one another. In the non-processing mode, the sheets are discharged by the second discharge means, while in the processing mode, sheets are discharged through a different section from the second discharge means, i.e., through the processed set discharge section formed above the second discharge means. Therefore, when, for example, the second discharge means composed of upper and lower discharge rollers is used, the discharge rollers are not required to be moved so as to form a discharge section between them or made in contact with one another between the processing mode and the non-processing mode.

The above arrangement enables the discharge rollers to be in contact with one another at a constant pressure, thereby stabilizing the movements of the rollers, namely, stabilizing the movement of the second discharge means. As a result, sheets can be prevented from being stuck in the second discharge means or slanted when being discharged, thereby achieving a stable discharging movement of sheets.

The second sheet post-processing apparatus of the present invention having the arrangement of the first sheet post-processing apparatus is characterized in that the sheet transport means includes a pair of transport rollers and transport roller drive means for driving the pair of transport rollers, and that a relative position of the pair of transport rollers is set such that sheets are conveyed by the pair of transport rollers along the sheet guide member.

In the above arrangement of the second sheet post-processing apparatus, the sheet transport means includes a pair of transport rollers, and a relative position between the transport rollers is set such that the sheets are transported by the transport rollers along the sheet guide member. Therefore, in the processing mode, the trailing edge of the sheets discharged by passing between the transport rollers are easily and desirably dropped onto the processing tray, while in the non-processing mode, the sheets discharged by passing between the transport rollers are surely guided to the second discharge means by the guide member.

As a result, in the processing mode, the sheets on the processing tray can be desirably aligned and thereafter the processing of the sheets can be easily carried out, while in the non-processing mode, the sheets can be desirably discharged onto the stacking tray.

The third sheet processing apparatus of the present invention having the arrangement of the first sheet post-processing apparatus of the present invention is characterized in that the sheet transport means includes a pair of transport rollers and transport roller drive means for driving the pair of transport rollers, and that the pair of transport rollers makes the sheet buckled from a leading edge to a trailing edge in a widthwise direction orthogonal to a sheet conveyance direction.

In the above arrangement of the third sheet post-processing apparatus, a sheet transported by the pair of transport rollers passes from the leading edge to the trailing edge in the widthwise direction orthogonal to the sheet conveyance direction. Therefore, the sheets are not likely to be deformed in the sheet conveyance direction, and after being discharged by passing between the transport rollers, the sheets can be easily guided along the sheet guide member. Moreover, in the processing mode, after being discharged by the transport rollers, the sheets can be smoothly placed on the processing tray. The above arrangement enables even thin sheets or sheets which are likely to be buckled in the sheet conveyance direction to be smoothly transported.

The fourth sheet post-processing apparatus of the present invention having the arrangement of the first sheet post-processing apparatus of the present invention is characterized by further comprising:

sheet entry detection means for detecting a state of the sheets transported by the sheet transport means; and sheet entry completion detection means for detecting that a sheet transportation by the sheet transport means is completed.

The fourth sheet post-processing apparatus is also characterized in that:

the processing tray is inclined in a direction where a sheet positioning member is placed at a lower position thereof;

the second discharge means is provided at a higher position of the processing tray and includes a pair of upper and lower discharge rollers and drive means for driving the pair of upper and lower discharge rollers;

the control means controls the upper discharge roller drive means so that the upper discharge roller rotates in a positive direction for discharging a sheet between the upper and lower discharge rollers onto the stacking tray when discharging the sheet in the non-processing mode, the control means controls in the processing mode, the upper discharge roller drive means so that the upper discharge roller rotates in a reversing direction when the sheet entry detection means detects a sheet being transported by the sheet transport means and rotates the upper discharge roller in the positive direction when the sheet entry completion detection means detects that a sheet transportation by the sheet transport means is completed, and that the upper discharge roller rotates in the reversing direction when discharging the sheets by the first discharge means.

According to the above arrangement of the fourth sheet post-processing apparatus, when discharging the sheets in the non-processing mode, the upper discharge roller rotates in the positive direction for discharging the sheets by passing between the upper and lower discharge rollers onto the stacking tray.

On the other hand, when transporting sheets in the processing mode by the sheet transport means, since the upper discharge roller is rotated in the inverted direction, the leading edge of the sheet transported over the upper discharge roller by the sheet transport means is guided in the sheet conveyance direction. As a result, the sheet transportation is supported so as to desirably transport the sheets. Moreover, in the processing mode, after the sheet transportation by the sheet transport means is completed, as the upper discharge roller rotates in the positive direction, the movement of the sheets to the sheet positioning member can be supported.

The above arrangement enables the transported sheets to be appropriately placed on a predetermined position set by the sheet positioning member on the processing tray. Moreover, when discharging the sheets by the first discharge means, as the upper discharge roller rotates in an inverted direction so as to support the processed sheets being discharged by the first discharge means, the sheets can be desirably discharged onto the stacking tray. As described, in the arrangement of the fourth sheet post-processing apparatus of the present invention, with the control on the upper discharge roller, sheet jamming due to the surface resistance of the upper discharge roller, the processing tray, etc., will not occur, thereby desirably transporting the sheets in the processing mode.

The fifth sheet post-processing apparatus of the present invention having the arrangement of the fourth sheet post-processing apparatus is characterized in that the control means controls the upper discharge roller drive means so as to stop the positive rotation of the upper discharge roller when weight of sheets stacked on the processing tray reaches a predetermined value under the condition that the sheet entry completion detection means detects that the sheet transportation by the sheet transport means is completed.

According to the above arrangement of the fifth sheet post-processing apparatus, in the processing mode, the upper discharge roller starts rotating in a sheet conveyance direction to the sheet positioning member (in the positive direction) when the first sheet is transported onto the upper discharge roller by the sheet transport means and is kept rotating until the weight of the sheets on the processing tray reaches a predetermined value.

As described, since the upper discharge roller is kept rotating when transporting the following sheets, the vibration generated from the rotations is transmitted to the sheets, thereby allowing the transported sheets to be placed appropriately at the predetermined position set by the sheet positioning member on the processing tray. On the other hand, when the weight of the sheets on the processing tray reaches a predetermined value, the upper discharge roller is stopped rotating. Therefore, the transporting force generated from the upper discharge roller will not increase due to the weight of the sheets, which may cause the bottom sheet damaged by being creased.

The sixth sheet post-processing apparatus of the present invention having the arrangement of the first sheet processing apparatus is characterized by further including:

a static electricity removing member provided so as to be capable of selectively moving between a static electricity removing position for sheets to be processed and discharged from the processed set discharge section by the first discharge means and a static electricity removing position for sheets not to be processed and discharged by the second discharge means; and static electricity removing member position change means for changing the position of the static electricity removing member.

The sixth sheet post-processing apparatus is also characterized in that the control means controls the static electricity removing member position change means so that the static electricity removing member is set in the static electricity removing position for sheets to be processed in the processing mode, while it is set in the static electricity removing position for sheets not to be processed in the non-processing mode.

According to the above arrangement, both in the processing mode and the non-processing mode, the static electricity on the sheet can be desirably removed by a single static electricity removing member, and the sheets discharged on the stacking tray can be desirably aligned.

The seventh sheet post-processing apparatus of the present invention having the arrangement of the first sheet post-processing apparatus is characterized by further comprising sheet entry completion detection means for detecting that a sheet transportation by the sheet transport means is completed, and in that the control means controls the sheet guide member drive means to move the sheet guide member back to the processing mode position when the sheet guide member position is changed from the processing mode position to the non-processing mode position after the sheet entry completion detection means detects that the sheet transportation is completed.

According to the above arrangement, the trailing edge of the sheets transported by the sheet transport means is pulled down by the sheet guide member as being moved to the non-processing mode position so as to be promptly dropped onto the processing tray, thereby improving the sheet transportation speed.

The eighth sheet post-processing apparatus of the present invention having the arrangement of the first sheet post-processing apparatus is characterized in that the control means controls the sheet guide member drive means so as to move the sheet guide member to a position for controlling an upward buckling of the sheets stacked on the processing tray when discharging the sheets by the first discharge means.

According to the above arrangement, when discharging the sheet by the first discharge means, the upward buckling of the sheets on the processing tray can be controlled by the sheet guide member. Therefore, even a processed set of few sheets or sheets of soft material can be desirably discharged onto the stacking tray by the first discharge means.

The ninth sheet post-processing apparatus of the present invention having the arrangement of the first or eight sheet post-processing apparatus is characterized in that the sheet guide member is provided with discharge failure detection means for detecting a discharge failure due to an upward buckling of sheets stacked on the processing tray in discharging the sheets by the first discharge means.

In the above arrangement of the ninth sheet post-processing apparatus, when discharging the sheets by the first discharge means, if a discharge failure occurs as the sheets on the processing tray are buckled, this discharge failure is detected by the discharge failure detection means. Thus, the discharge failure of the processed sheets by the first discharge means can be accurately detected, thereby preventing the processed sheets from being badly damaged.

The tenth sheet post-processing apparatus having the arrangement of the first sheet post-processing apparatus is characterized by further including:

sheet guide member displacement detection means for detecting a displacement of the sheet guide member by being pushed by a buckled sheet.

According to the above arrangement, the sheet guide member in the processing mode position which is is displaced by being pushed by the buckled sheet is detected by the sheet guide member displacement detection means, thereby accurately detecting the sheets being stuck on the processing tray if occurred, for example, in transporting the sheet.

The eleventh sheet post-processing apparatus having the arrangement of the first sheet post-processing apparatus is characterized in that:

the second discharge means includes a pair of upper and lower discharge rollers and upper and lower discharge roller drive means for respectively driving the pair of upper and lower discharge rollers, and the control means controls the lower discharge roller drive means so as to rotate the lower discharge roller only with a discharging movement of the sheets onto the stacking tray.

According to the above arrangement, the lower discharge roller which constitutes the second discharge means with the upper discharge roller rotates only with the discharging movement of the sheets onto the stacking tray and otherwise it is stopped. Thus, the rotation time of the lower discharge roller can be kept minimum, and the sheets on the stacking tray can be prevented from being dirty or damaged.

The twelfth sheet post-processing apparatus of the present invention is characterized by including:

sheet transport means for transporting sheets from an external section into the apparatus;

a processing tray for placing thereon sheets to be processed;

a stacking tray for placing thereon sheets discharged from the apparatus;

sheet processing means for processing sheets stacked on the processing tray;

first discharge means for discharging onto the stacking tray a set of sheets processed by the sheet processing means through the processed set discharge section, second discharge means for discharging sheets onto the stacking tray, the second discharge means being provided at a portion on a sheet discharge side of the processing tray;

a first guide member provided along a sheet transport path extending from the sheet transport means to the second discharge means, the first guide member being capable of selectively moving between a processing mode position for guiding a leading edge of sheets transported by the sheet transport means to the processed set discharge section so as to drop the sheets onto the processing tray and a non-processing mode position for guiding the leading edge of the sheets to the second discharge means, the first guide member forming an opening of the processed set discharge section above the second discharge means when the first guide member is moved to the processing mode position;

a second guide member provided on the side of the second discharge means, the second guide member being capable of selectively moving between a non-processing mode position for guiding sheets to the second discharge means together with the first guide member in the non-processing mode position and a processing mode position for guiding sheets discharged by the first discharge means to the processed set discharge section;

a drive member which mates with both the first guide member and the second guide member, which selectively moves the first guide member and the second guide member between respective processing mode positions and non-processing mode positions;

drive member drive means for driving the drive member; and control means for controlling the drive member drive means so that the first and second guide members are placed at the processing mode position in the processing mode, while the first and second guide members are placed at the non-processing mode position in the non-processing mode.

According to the arrangement of the twelfth sheet post-processing apparatus, in the processing mode, the sheets transported into the apparatus by the sheet transportation means are guided by the first guide member provided in the processing mode position, and after conveying the leading edge of the sheets to the processed set discharge section, the sheets are dropped on the processing tray. As described, the sheets placed on the processing tray are first processed by the processing means, and thereafter, the sheets are guided by the second guide member in the processing mode position and discharged onto the stacking tray by the first discharge means through the processed set discharge section.

On the other hand, in the non-processing mode, the sheets transported into the apparatus are guided by the first and second guide members in respective non-processing mode positions, and after being moved to the second discharge means, the sheets are discharged onto the stacking tray by the second discharge means.

As described, in the arrangement of the twelfth sheet post-processing apparatus of the present invention, when discharging the sheets onto the stacking tray, the sheets are guided by both the first guide member and the second guide member or by the second guide member, thereby achieving a desirable discharge of the sheets onto the stacking tray. Moreover, since the first and second guide members are driven by the driving member and the drive member drive means, i.e., by the single drive means, the structure of the apparatus can be simplified, and the manufacturing cost can be reduced. Furthermore, the first guide member and the second guide member are moved to the respective positions of the same mode, either the processing mode position or the non-processing mode position, thereby preventing sheet jamming by being caught by one of the guide members due to the difference in the wait positions of the first guide member and the second guide member.

The thirteenth sheet post-processing apparatus of the present invention is characterized by including:

sheet transport means for transporting sheets from an external section into the apparatus;

a processing tray for placing thereon sheets to be processed, the processing tray being included with a sheet positioning member at a lower position;

a stacking tray for placing thereon sheets discharged from the apparatus;

sheet processing means for processing sheets stacked on the processing tray;

first discharge means for discharging onto the stacking tray a set of sheets on the processing tray processed by the sheet processing means through the processed set discharge section;

second discharge means for discharging sheets onto the stacking tray, the second discharge means being provided at a higher position of the processing tray in a sheet discharge direction;

a first guide member provided along a sheet transport path extending from the sheet transport means to the second discharge means, the first guide member being capable of selectively moving between a processing mode position for guiding a leading edge of sheets transported by the sheet transport means to the processed set discharge section so as to drop the sheets onto the processing tray and a non-processing mode position for guiding the leading edge of the sheets to the second discharge means, the first guide member being set so as to form an opening of the processed set discharge section above the second discharge means when the first guide member is set in the processing mode position;

a second guide member provided on the side of the second discharge means, the second guide member being capable of selectively moving between a non-processing mode position for guiding sheets to the second discharge means together with the first guide member in the non-processing mode position and a processing mode position in contact with the processing tray for guiding sheets discharged by the first discharge means to the processed set discharge section;

first guide member drive means for driving the first guide member;

second guide member drive means for driving the second guide member, and control means for controlling the first and second guide member drive means so that the first and second guide members are set to the respective processing mode positions in the processing mode, while the first and second guide members are moved to the respective non-processing mode positions in the non-processing mode, and for controlling the second guide member drive means so that when sheets are placed on the processing tray at least by the sheet transport means, the second guide member vibrates so that the processing tray resonates.

According to the above arrangement of the thirteenth sheet post-processing apparatus, in the processing mode, the sheets transported into the apparatus by the sheet transport means are guided by the first guide member in the processing mode position, and after the leading edge of the sheets are guided to the processed set discharge section, the sheets are dropped onto the tilted processing tray. Then, the sheets are moved along the processing tray to the position in contact with the sheet positioning member to be placed at a predetermined position set by the sheet positioning member. Here, the second guide member in the processing mode position and in contact with the processing tray vibrates, and thus the processing tray resonates. Thus, the sheets can be promptly moved to the sheet positioning member. Thereafter, the sheets processed by the processing means are guided by the second guide member and discharged onto the stacking tray by the first discharge means through the processed set discharge section.

On the other hand, in the non-processing mode, the sheets fed into the apparatus are guided by the first and second guide members in the non-processing mode positions to the second discharge means to be discharged onto the stacking tray by the second discharge means. As described, when discharging the sheets onto the stacking tray, the sheets are guided using both the first and the second guide member or using the second guide member. As a result, a desirable discharge of the sheets onto the stacking tray can be achieved.

For a fuller understanding of the nature and advantages of the invention, reference should be made to the ensuing detailed description taken in conjunction with the accompanying drawings.

BRIEF DESCRIPTION OF THE DRAWINGS

FIG. 1 through FIG. 11 show one embodiment of the present invention, wherein:

FIG. 1 is a front view showing a schematic configuration of a sheet post-processing apparatus, FIG. 2 is a front view showing essential parts of the sheet post-processing apparatus of FIG. 1, showing the operation in a non-staple mode, FIG. 3 is a perspective view of essential parts of the sheet post-processing apparatus of FIG. 1, showing an operation in the non-stable mode, FIG. 4 is a front view showing essential parts of the sheet post-processing apparatus of FIG. 1, showing the operation in a staple mode, FIG. 5 is a perspective view of essential parts of the sheet post-processing apparatus of FIG. 1, showing an operation in the stable mode, FIG. 6 is block diagram showing a control device provided in the sheet post-processing apparatus of FIG. 1, FIG. 7 is a flow chart showing operations of the sheet post-processing apparatus in the non-staple mode with the control by the control device of FIG. 6, FIG. 8 is a flow chart showing operations of the sheet post-processing apparatus in the non-staple mode to be carried out after the operations shown in FIG. 7, FIG. 9 is a flow chart showing operations of the sheet post-processing apparatus in the staple mode to be carried out after the operations shown in FIG. 7, FIG. 10 is a flow chart showing operations of the sheet post-processing apparatus in the staple mode to be carried out after the operations shown in FIG. 9, and FIG. 11 is a flow chart showing operations of the sheet post-processing apparatus in the staple mode to be carried out after the operations shown in FIG. 10.

FIG. 12 through FIG. 16 show another embodiment of the present invention, wherein:

FIG. 12 is a front view showing a schematic configuration of a sheet post-processing apparatus, FIG. 13 is a block diagram showing a control device provided in the sheet post-processing apparatus, FIG. 14 is a flow chart showing operations of the sheet post-processing apparatus in the staple mode with the control by the control device shown in FIG. 13 to be carried out after the operations shown in FIG. 7, FIG. 15 is a flow chart showing operations of the sheet post-processing apparatus to be carried out after the operations shown in FIG. 14, and FIG. 16 is a flow chart showing operations of the sheet post-processing mode in the staple mode to be carried out after the operations shown in FIG. 15.

FIG. 17 through FIG. 23 show still another embodiment of the present invention, wherein:

FIG. 17 is a front view schematically showing essential parts of the sheet post-processing apparatus, FIG. 18 is a block diagram showing a control device provided in the sheet post-processing apparatus of FIG. 17, FIG. 19 is a perspective view showing descending and ascending movements of the movable sheet guide in the sheet post-processing apparatus of FIG. 17, FIG. 20 is a front view schematically showing a state where the movable sheet guide is placed at the discharge guide position and the state where sheet jamming occurred in the above state of the sheet post-processing apparatus of FIG. 17, FIG. 21 is a flow chart showing operations of the sheet post-processing apparatus of FIG. 17 in the staple mode with the control by the control device shown in FIG. 18 to be carried out after the operations shown in FIG. 7, FIG. 22 is a flow chart showing operations of the sheet post processing apparatus of FIG. 17 in the staple mode to be carried out after the operations shown in FIG. 21, and FIG. 23 is a flow chart showing operations of the sheet post-processing apparatus in the staple mode to be carried out after the operation shown in FIG. 22.

FIG. 25 through FIG. 31 show still another embodiment of the present invention, wherein:

FIG. 25 is an explanatory view showing the configuration of the transport roller in a sheet post-processing apparatus, FIG. 26 is an explanatory view showing another arrangement of FIG. 25, FIG. 27 is an explanatory view showing still another arrangement of FIG. 25, FIG. 28 is a front view showing an arrangement for driving the movable sheet guide and the gate in the sheet post-processing apparatus, FIG. 29 is a perspective view showing the state in the non-staple mode in the arrangement of FIG. 28, FIG. 30 is a perspective view showing the state in the staple mode in the arrangement of FIG. 28, and FIG. 31 is a block diagram showing a control device provided in the sheet post-processing apparatus.

DESCRIPTION OF THE EMBODIMENTS

The following description will discuss one embodiment of the present invention with reference to FIG. 1 through FIG. 11.

Figure 1:
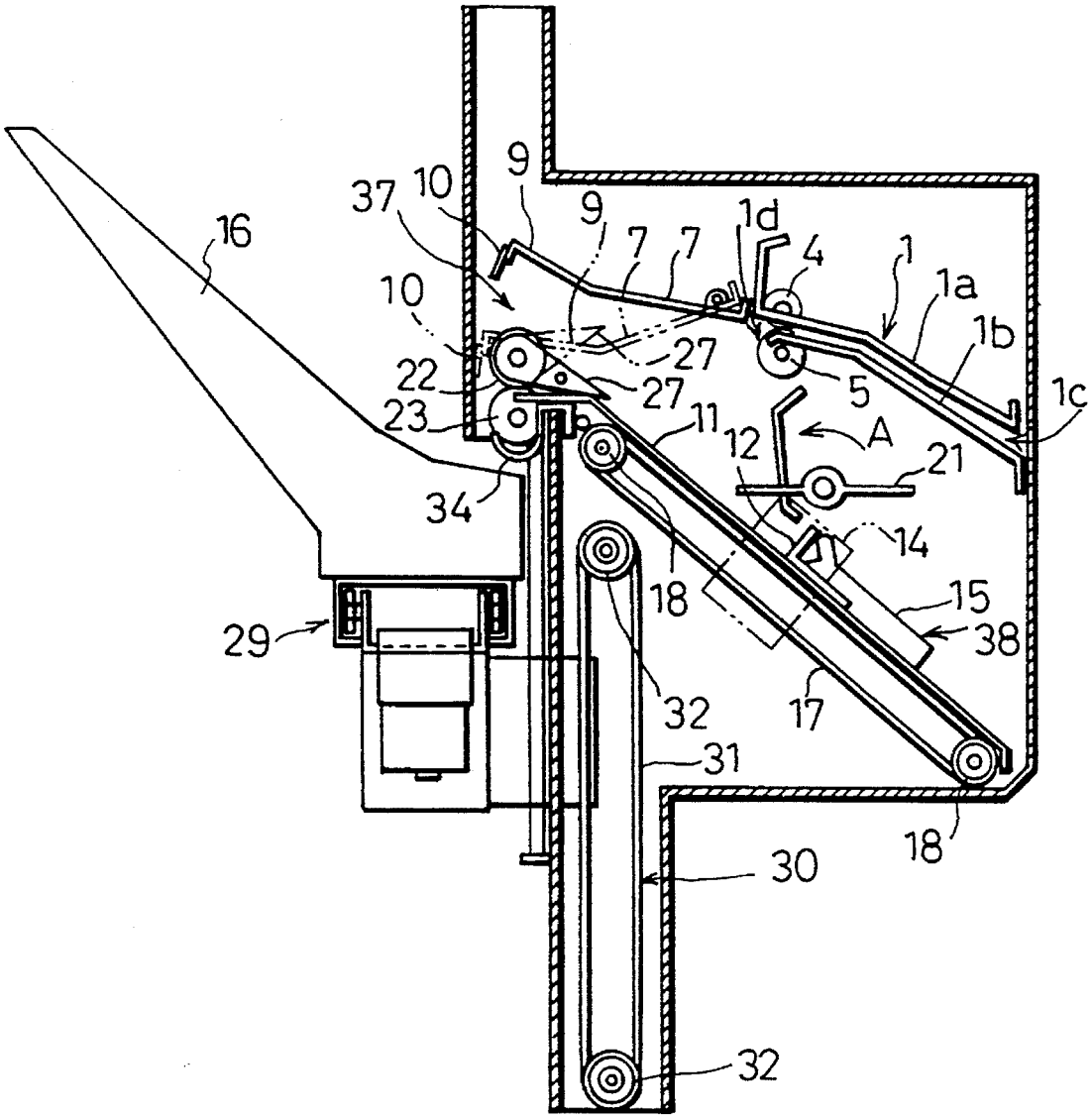
Figure 2:
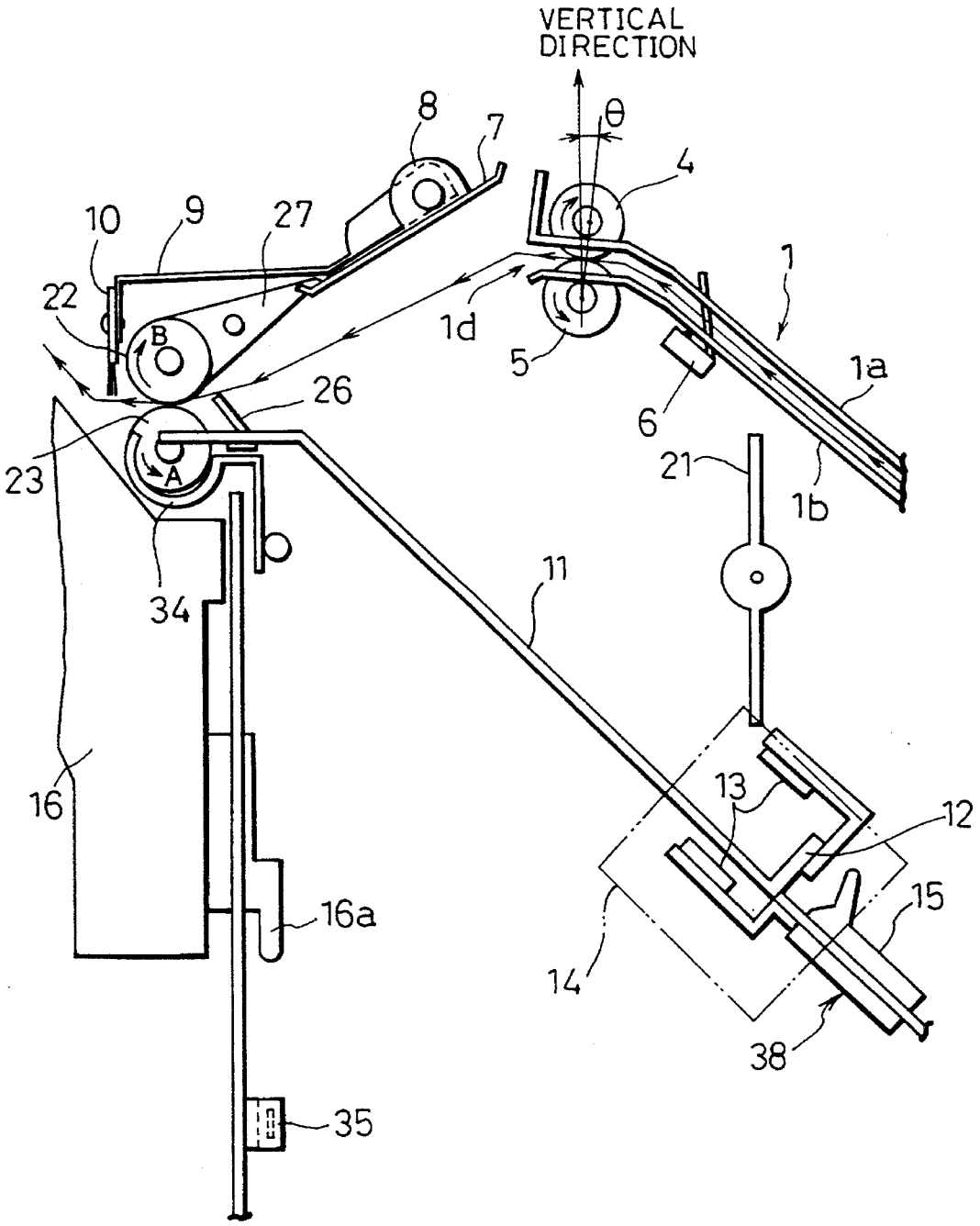
Figure 4:
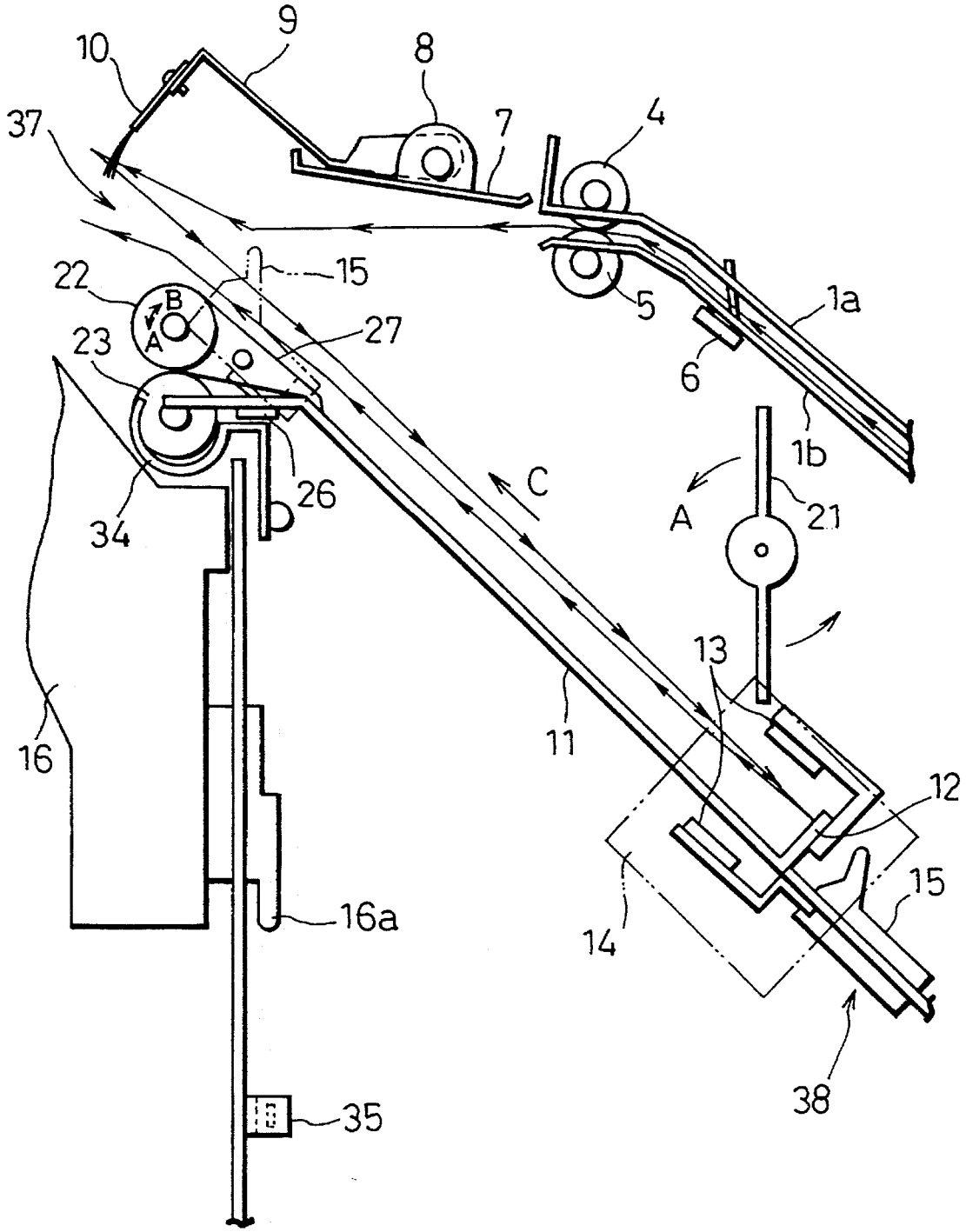

A sheet post-processing apparatus shown in FIG. 1 of the present embodiment is combined, for example, with a copying machine main body as a main device. The sheet post-processing apparatus is provided with a sheet transport path 1 for transporting sheets from the main body. The sheet transport path 1 is composed of an upper sheet guide 1*a* and a lower sheet guide 1*b*. The end of the sheet transport path 1 on the side of the main body is an entry opening 1*c* and the other end of the sheet transport path 1 is a discharge opening 1*d*. A pair of upper and lower transport rollers 4 and 5 is formed at the end of the sheet transport path 1 where discharge opening 1*d* is formed. The pair of transport rollers 4 and 5 is driven by a transport motor 20, to be described later, as transport roller drive means. Here, the transport motor 20, the transport rollers 4 and 5 constitute sheet transport means. As shown in FIG. 2 and FIG. 4, a feed sensor 6 (sheet entry detection means) is provided along the sheet transport path 1 at a position closer to the entry opening 1*c* than the position where the transport rollers 4 and 5 are provided.

A relative position between the transport roller 4 and the transport roller 5 is set such that sheets transported therethrough are guided along a movable sheet guide 7 (sheet guide member and first guide member) provided at the output of the sheet transport path 1. Therefore, in the present embodiment, the transport roller 4 is provided at such a position that a line connecting the center of the transport roller 4 and the center of the transport roller 5 forms an angle θ with respect to a vertical direction to the side of the entry opening 1*c*. The angle θ is set such that sheets transported through the sheet transport path 1 by the transport rollers 4 and 5 are guided along the movable sheet guide 7 provided at the output of the sheet transport path 1.

The movable sheet guide 7 is rotated about a member provided on the side of the sheet transport path 1 by a sheet guide displacement motor 8 (sheet guide member drive means, first guide member drive means and static electricity removing member position change means) to be moved to a non-processing mode position shown in FIG. 2 and a processing mode position shown in FIG. 4. The movable sheet guide 7 in each position is detected by a guide position sensor 39 (see FIG. 6). The movable sheet guide 7 is provided with a brush support member 9 and a remover brush 10 (static electricity removing member) attached to the upper end of the brush support member 9. The remover brush 10 removes a static electricity on the sheets without making contact with the sheets. Here, the remover brush 10 may be arranged so as to be in contact with a sheet; however, in order to transport the sheet straight, the non-contact type remover brush by which no external force is exerted on sheets is more preferable.

As shown in FIG. 2, a staple tray 11 (processing tray) is provided below the discharge opening 1*d* of the sheet transport path 1 so as to form a downward to the side corresponding to the entry opening 1*c*. The staple plate 11 is provided with a sheet trailing edge positioning plate 12 (sheet positioning member) for positioning the trailing edge of the sheets to be placed on the staple tray 11, a transparent staple tray sheet sensor 13 for detecting whether or not a sheet exists on the staple tray 11, a stapler 14 (sheet processing means) for fastening the sheets placed on the staple tray 11, a pushing member 15 for pushing out a stapled set of sheets on the staple tray 11 onto a stacking tray 16. As shown in FIG. 1, the pushing member 15 is provided on the belt 17 provided under the staple tray 11, which is supported by a pair of belt support rollers 18. Either one of the belt support rollers 18 is driven by a pusher motor 19 (see FIG. 6), to be described later, so as to drive the belt 17, thereby moving the pushing member 15 in a pushing-out direction and also in the opposite direction. Here, the pushing member 15, the belt 17, the belt support rollers 18 and the pusher motor 19 constitute a push out unit 38 (first discharge means).

A rotating blade 21 made of, for example, a rubber is provided as sheet transport auxiliary means above the staple tray 11. The rotating blade 21 is rotated in the direction of A in FIG. 1 by a motor (not shown) so that a sheet transported through the sheet transport path 1 onto the staple tray 11 is moved along the staple tray 11 until the trailing edge of the sheet comes in contact with the sheet trailing edge positioning plate 12.

In the vicinity of the upper end of the staple tray 11 on a sheet discharge side, a pair of upper discharge roller 22 and the lower discharge roller 23 is provided. The upper discharge roller 22 and the lower discharge roller 23 are respectively driven by an upper discharge motor 24 (upper discharge roller drive means) and a lower discharge motor 25 (lower discharge roller drive means) which will be described later. Here, upper and lower discharge rollers 22 and 23 and the upper and lower discharge motors 24 and 25 constitute the second discharge means. As shown in FIG. 2, a non-staple discharge sensor 26 is provided at the upstream of the upper and lower discharge rollers 22 and 23 on the staple tray 11 for detecting the sheet discharged through the upper and lower discharge rollers 22 and 23.

Furthermore, in the vicinity of the discharge side of the staple tray 11, a gate 27 (second guide member) which rotatably moves about the shaft of the upper discharge roller 22 is provided. The gate 27 is driven by a gate switching motor 28 as second guide member drive means (see FIG. 6), to be described later, so as to move to the non-staple mode position (shown in FIG. 2) and to the staple mode position (shown in FIG. 4).

The stacking tray 16 is provided below the upper and lower discharge rollers 22 and 23 outside the apparatus in a sheet discharge direction. The upper surface of the stacking tray 16 is inclined so as to be substantially parallel to the staple tray 11. The stacking tray 16 is driven by a shift mechanism 29 (see FIG. 1) in a direction traverse to the sheet discharge direction. The stacking tray 16 is raised and lowered by an elevator mechanism 30. The elevator mechanism 30 includes a belt 31, upper and lower belt support rollers 32 and an elevator motor 33 (see FIG. 6), to be described later, for driving either one of the belt support rollers 32. The belt 31 is connected to the stacking tray 16 through the shift mechanism 29, and the stacking tray 16 is raised or lowered by moving the belt 31. When the stacking tray 16 reaches an upper limit position, the stacking tray 16 at this position is detected by a tray upper limit sensor 34. The tray upper limit sensor 34 is provided above the stacking tray 16. The tray upper limit sensor 34 is composed of a switch which is turned ON when it contacts with the upper surface of the stacking tray 16 or the upper surface of the sheets placed on the stacking tray 16. On the other hand, when the stacking tray 16 reaches a lower limit position, the stacking tray 16 at this position is detected by the tray lower limit sensor 35 which is turned ON when it contacts with a projection 16*a* (see FIG. 2) attached to the stacking tray 16.

Figure 6:
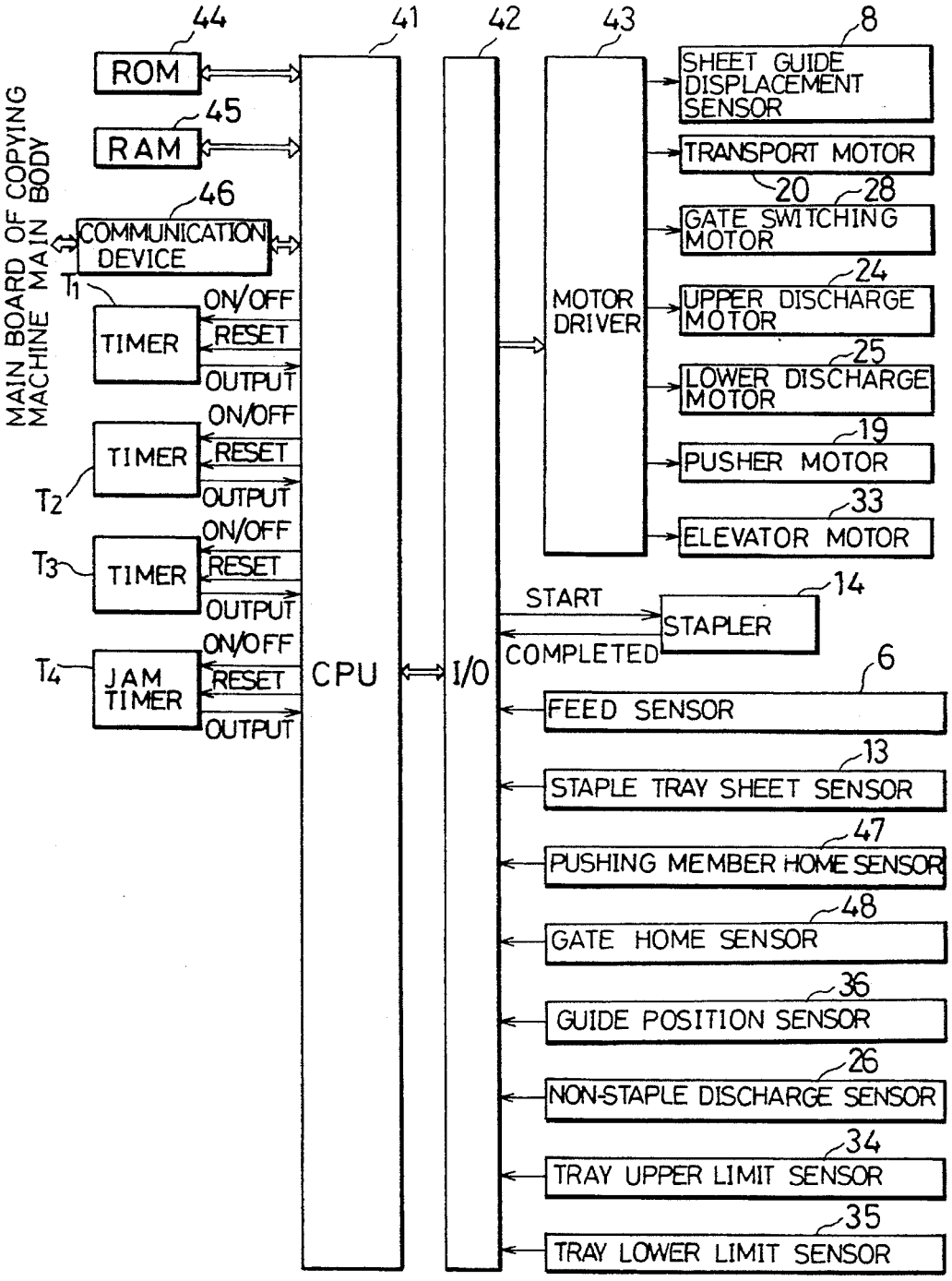

The sheet post-processing apparatus of the present embodiment is provided with a control device shown in FIG. 6. The control device includes a CPU 41 as a control device, an input/output interface 42, a motor driver 43, a ROM 44 for storing therein an operation program of the CPU 41, a RAM 45 for temporarily storing various data, a communication device 46 for communicating with a main board of the copying machine main body, timers $T_1$ through $T_3$ and a jam timer $T_4$. The CPU 41 transmits and receives information indicative of whether the set mode is a staple mode in which stapling process is carried out or a non-stapling mode in which the stapling process is not carried out, information indicative of sheet size and information indicating a trouble such as sheet jamming, etc., occurred. The CPU 41 controls the stapler 14 and each motor based on information thus obtained and information indicate of sheet transport time and a position of each load from each sensor. The CPU 41, ROM 44 and the guide position sensor 36 constitute the control means for the movable sheet guide 7. Similarly, the CPU 41 and the ROM 44 constitute the control means of the upper discharge roller 22.

The timer $T_1$ controls a timing at which the rotating direction of the upper discharge roller 22 is switched, while the timer $T_2$ controls a timing at which the elevator motor 33 in the staple mode is inverted, namely the timer $T_2$ controls a timing for adjusting the level. The timer $T_3$ controls a timing at which the height of the stacking tray 16 in the non-staple mode is adjusted. The jam timer $T_4$ controls a timing for determining that sheet jamming occurs based on the detection of the sheet by the staple tray sheet sensor 13 and the non-staple discharge sensor 26. Therefore, the timer $T_1$ and the feed sensor 6 constitute the sheet entry completion detection means.

The motor driver 43 is connected to the sheet guide displacement motor 8 for driving the movable sheet guide 7, the transport motor 20 for driving the transport rollers 4 and 5, the gate switching motor 28 for driving the gate 27, the upper discharge motor 24 for driving the upper discharge roller 22, the lower discharge motor 25 for driving the lower discharge roller 23, the pusher motor 19 for driving the pushing member 15 and the elevator motor 33 for driving the stacking tray 16.

The CPU 41 is connected to the feed sensor 6 of the sheet transport path 1, the staple tray sheet sensor 13, a pushing member home sensor 47 for detecting the standby state of the pushing member 15 (see FIG. 2), a gate home sensor 48 for detecting the gate 27 both in the non-staple mode position and in the staple mode position, the guide position sensor 36 for detecting the movable sheet guide 7 both in the non-staple mode position and in the staple mode position, the non-staple discharge sensor 26, the tray upper limit sensor 34 and the tray lower limit sensor 35 via an input/output interface 42.

In the above arrangement, first the basic operations of the sheet post-processing apparatus in the non-staple mode and the staple mode are explained with reference to FIG. 2 through FIG. 5. Here, arrows show the trace of the sheet.

Figure 3:
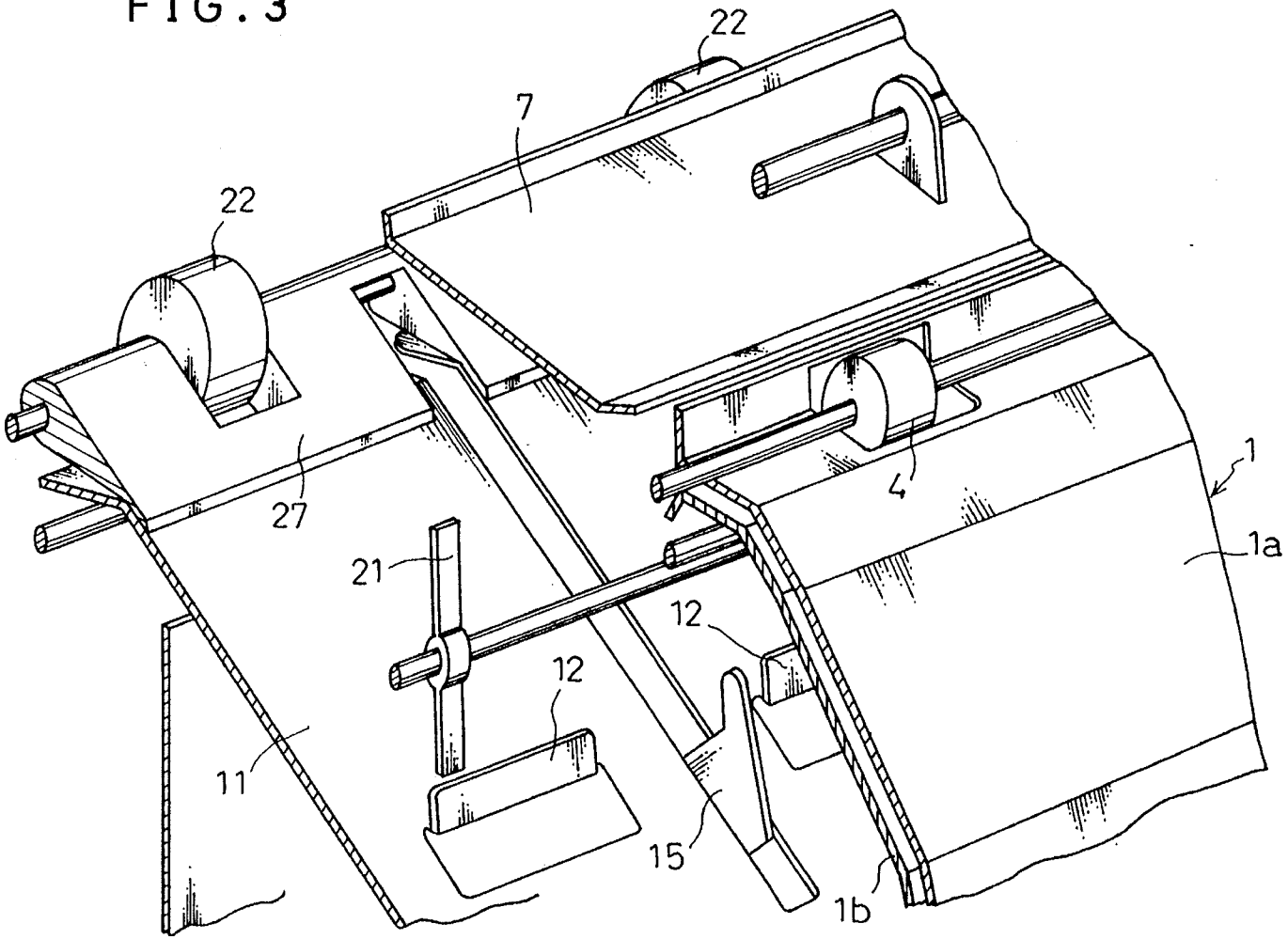

As shown in FIG. 2 and FIG. 3, the movable sheet guide 7 is arranged such that the end thereof on the discharge side is moved down in the non-staple mode, while the end of the gate 27 to the side of the movable sheet guide 7 is moved upward so that the above two ends are connected. Namely, the movable sheet guide 7 and the gate 27 are positioned so that the sheet can be transported so as to pass between the upper sheet roller 22 and the lower sheet roller 23.

In the above state, the sheet transported by passing between the transfer rollers 4 and 5 through the sheet transport path 1 is placed between the upper and lower discharge rollers 22 and 23 by the movable sheet guide 7 and the gate 27, and the sheet is discharged onto the staking tray 16 by the upper and lower discharge rollers 22 and 23. As previously described, the upper transport roller 4 is provided at such a position that the line connecting the center of the transport roller 4 and the center of the transport roller 5 forms an angle θ to the vertical line towards the entry opening 1*c*. Thus, the sheet transported through the sheet transport path 1 by the transport rollers 4 and 5 is guided along the movable sheet guide 7. Therefore, the sheet can be accurately transported to a position between the upper and lower discharge rollers 22 and 23, thereby desirably discharging the sheet onto the stacking tray 16.

Moreover, when the movable sheet guide 7 is placed at the non-staple mode position, the remover brush 10 is positioned at the sheet discharge side of the upper discharge roller 22. Therefore, a charge on the sheet to be discharged through the upper and lower discharge rollers 22 and 23 is removed by the remover brush 10, and a desirable alignment of sheets stacked on the stacking tray 16 can be achieved.

Figure 5:
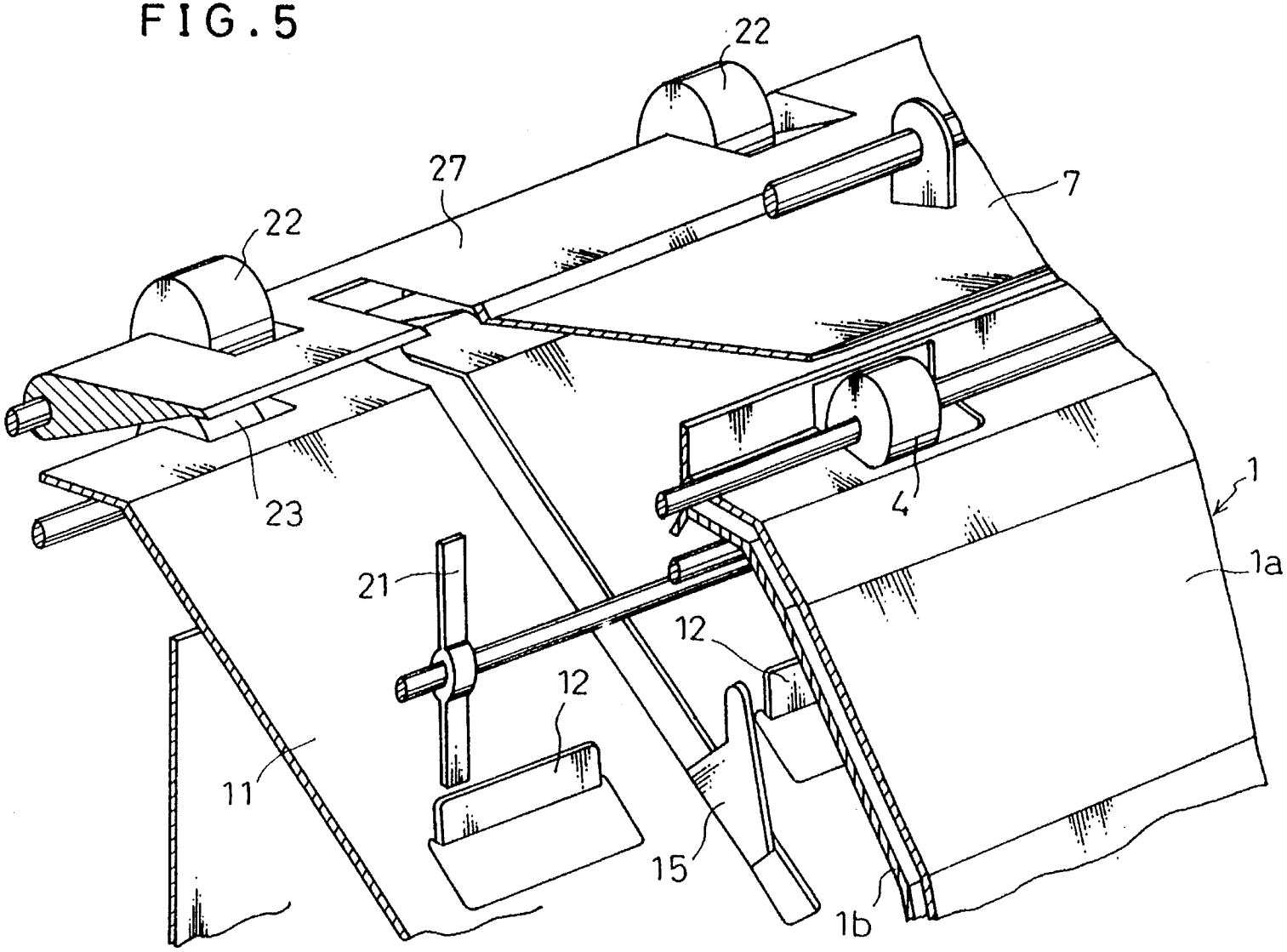

On the other hand, as shown in FIG. 4 and FIG. 5, in the staple mode, the end of the movable sheet guide 7 on the discharge side is moved upward, and the end of the gate 27 on the other side of the discharge rollers 22 and 23 is moved downward so as to be in contact with the upper surface of the staple tray 11, and a discharge opening 37 (processed set discharge section) is formed between the upper discharge roller 22 and the movable sheet guide 7. Here, with the movement of the movable sheet guide 7, the remover brush 10 is moved to the position at which a charge on the sheet being discharged can be removed without disturbing the discharge of the sheet through the discharge opening 37.

Then, the sheet being transported through the sheet transport path 1 by the transport rollers 4 and 5 is dropped onto the staple tray 11 by the dead weight, and is moved along the slope of the staple tray 11 until the trailing edge thereof reaches the sheet trailing edge positioning plate 12. Here, the transportation of the sheet is supported by the rotary vane 21 being rotated in the direction of A. Moreover, the alignment of the sheets in the widthwise direction may be carried out by an aligner plate provided on the staple tray 11, which is driven in the widthwise direction.

As described, when a predetermined number of sheets are stacked on the staple tray 11, stapling processes are carried out by the stapler 14. Thereafter, the pushing member 15 is moved in the direction of C so as to push the sheet on the staple tray 11, thereby discharging the sheet onto the stacking tray 16 through the discharge opening 37. Here, a charge on the sheet is removed by the remover brush 10.

Operations by the sheet post-processing apparatus of the present embodiment based on the control by the CPU 41 are explained in detail with reference to the flow charts shown in FIG. 7 through FIG. 11.

Figure 7:
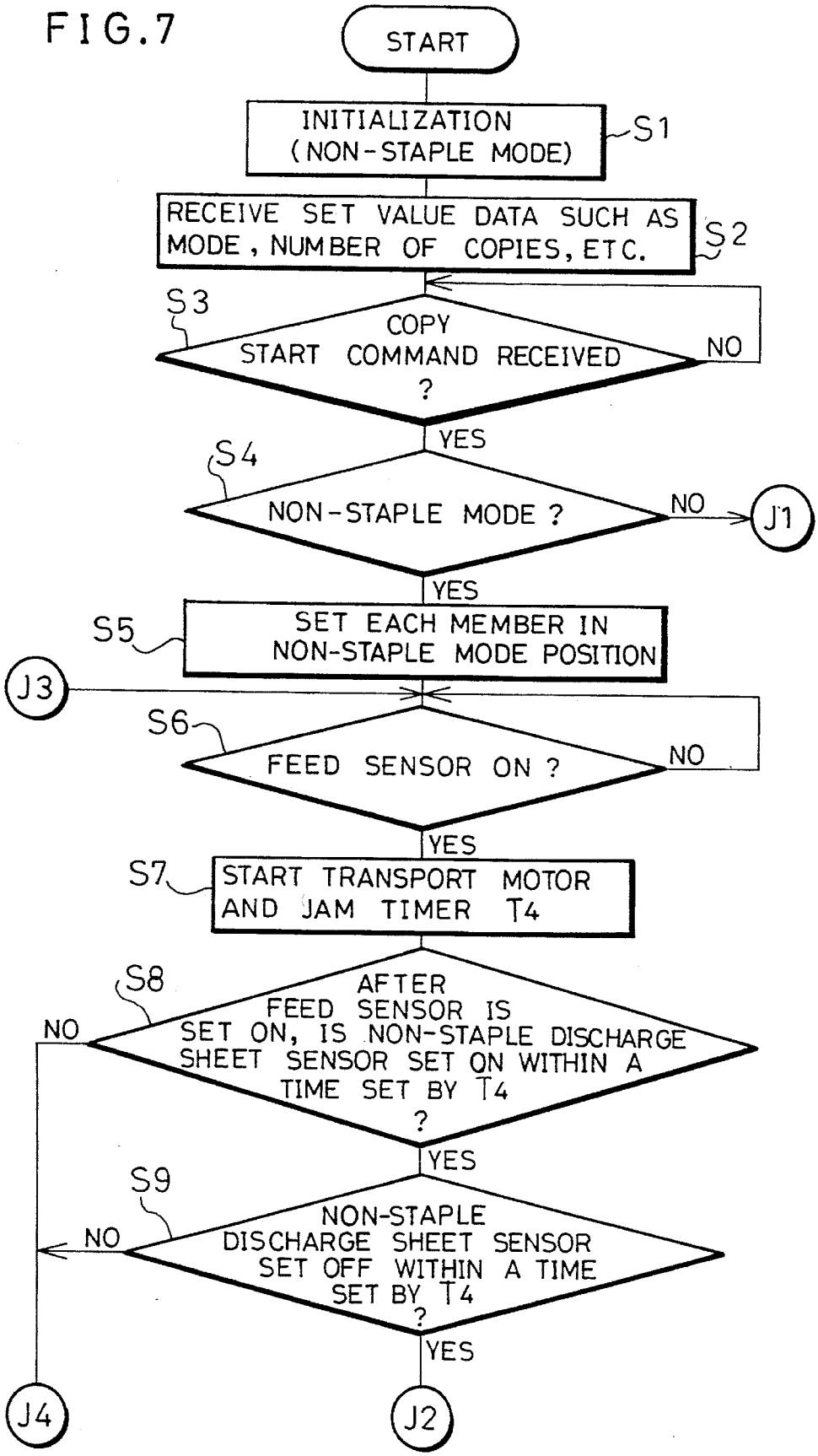

As shown in FIG. 7, first, an initialization is carried out, and the apparatus is set in a standby state for receiving instructions from the main body of the copying machine (S1). In the initialization process, it is assumed, for example, each member is set in the non-staple mode. Therefore, in this state, by controlling the sheet guide displacement motor 8 (see FIG. 2 and FIG. 6) and the gate switching motor 28 (see FIG. 6), the movable sheet guide 7 and the gate 27 are placed at the respective non-staple mode positions shown in FIG. 2. The above state is detected by the gate home sensor 48 (see FIG. 6) and the guide position sensor 36 (see FIG. 6).

Next, data indicating a mode, a set number of copies, etc., is received from the main body of the copying machine (S2), and when a copy start command is received (S3), if the received finishing mode is the non-stapling mode (S4), it is checked whether every member is set in the non-staple mode, and if there is any member which is not in the non-staple mode, the member is set in the non-staple mode (S5).

The sheet is fed through the sheet transport path 1, and when the feed sensor 6 is set ON (S6), a transport motor 20 (see FIG. 6) and the jam timer $T_4$ are started (S7). As a result, the transport rollers 4 and 5 start rotating, and the sheet is transported so as to pass between the upper and lower discharge rollers 22 and 23 while being guided by the movable sheet guide 7 and the gate 27.

Next, it is determined whether the non-staple discharge sensor 26 is set ON within a predetermined time set by the jam timer $T_4$ (S8), and if so, the jam timer $T_4$ is started when the non-staple discharge sensor 26 is set ON. Thereafter, it is determined whether the non-staple discharge sensor 26 is set OFF within a predetermined time set by the jam timer $T_4$ (S9). Here, when the leading edge of the sheet is detected by the non-staple discharge sensor 26, the upper discharge roller 22 rotates in a direction of B (positive direction), while the lower discharge roller 23 rotates in a direction of A (positive direction).

Figure 8:
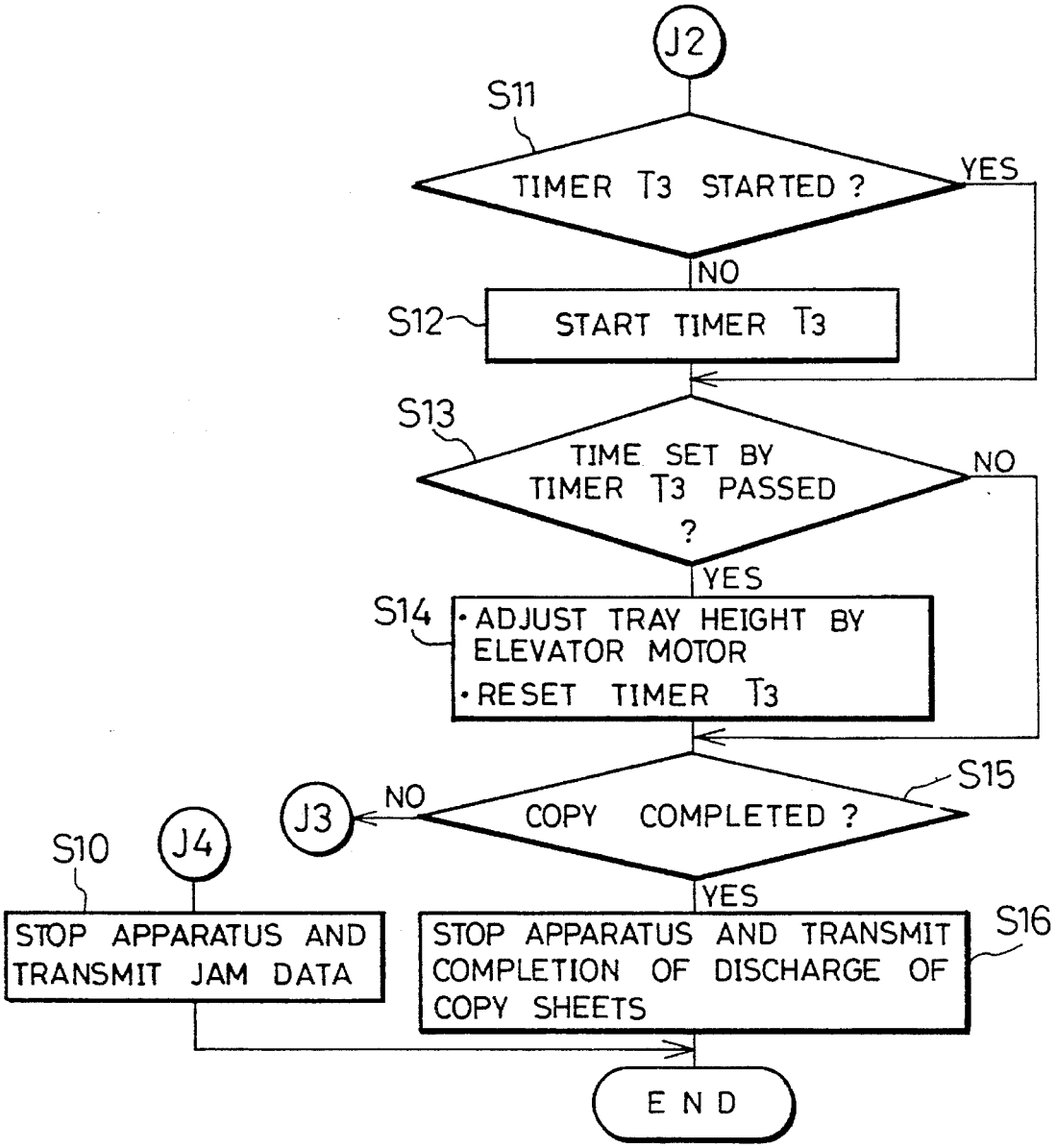

On the other hand, if not either in S8 or S9, it is determined that sheet jamming occurred, and the sequence is moved to S10 of FIG. 8, and the operation of the apparatus is stopped. In the meantime, information indicating that sheet jamming occurred is transmitted to the copying machine main body through the communication device 46 (see FIG. 6).

On the other hand, if it is determined in S9 that the non-staple discharge sensor 26 is set OFF within a predetermined time set by the jam timer $T_4$, and the sheet being transported is the first sheet, since the timer $T_3$ for controlling a timing for adjusting the height of the stacking tray 16 is not started (S11), the timer $T_3$ is started (S12). For the following sheets, the process in S12 is not required.

When a predetermined time set by the timer $T_3$ has passed (S13), the elevator motor 33 is controlled so as to adjust the height of the stacking tray 16 based on the detection by the tray upper limit sensor 34. In the meantime, the timer $T_3$ is stopped and reset (S14).

Thereafter, when a predetermined number of copies has not been completed, the sequence goes back to S6, and the above processes are repeated (S15). On the other hand, if a predetermined number of copies is completed, the operation of the apparatus is stopped, and the information indicating that the discharge of the copy sheets is completed is transmitted to the main body of the copying machine (S16).

Figure 9:
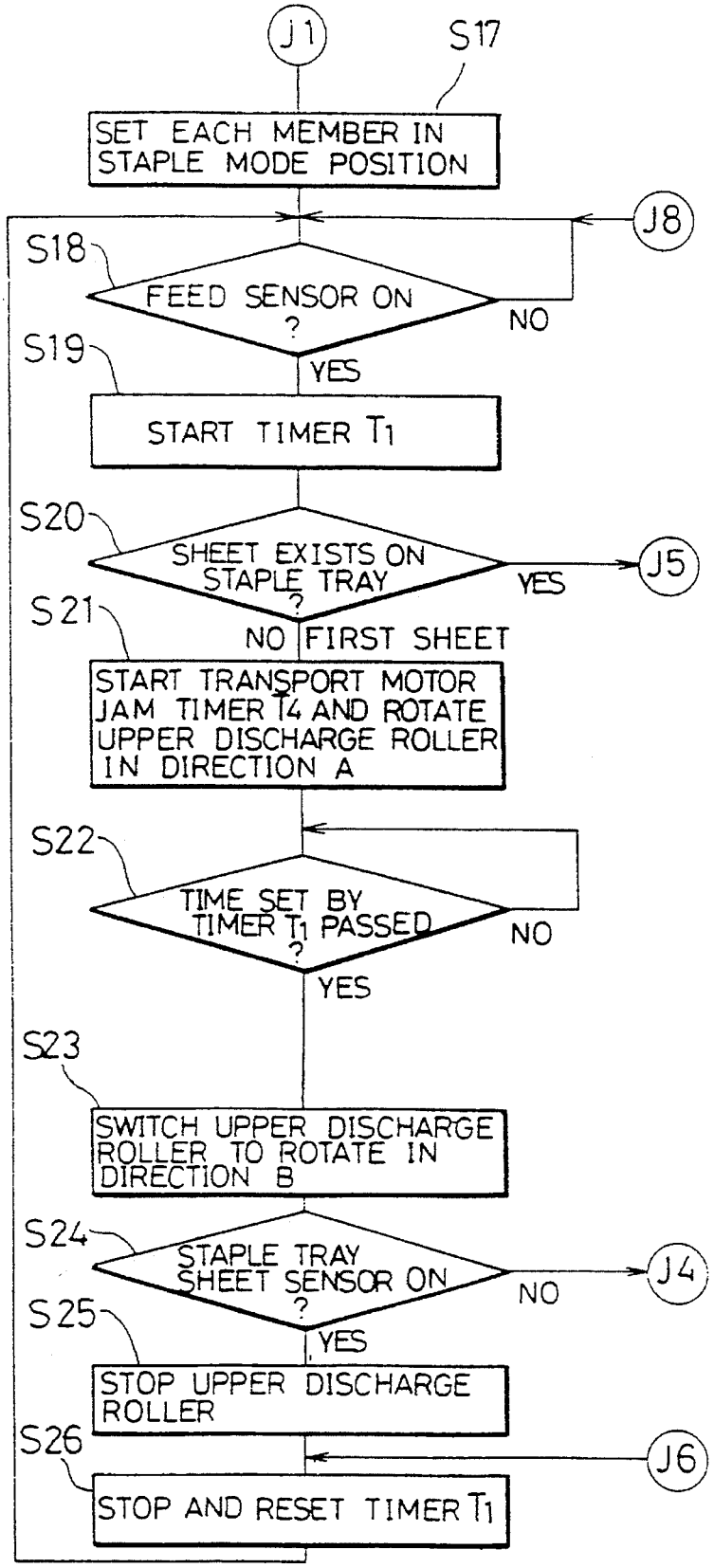

If the apparatus is set in the staple mode in S4, in S17 of FIG. 9, the movable sheet guide 7 and the gate 27 are placed at the respective staple mode positions shown in FIG. 4.

When the sheet is transported through the sheet transport path 1 and the feed sensor 6 is set ON (S18), the timer $T_1$ is started for controlling the timing at which the rotating direction of the upper discharge roller 22 is switched (S19), and it is determined whether or not a sheet exists on the staple tray 11 based on the detection by the staple tray discharge sensor 13 (S20). As a result, if the sheet being transported is the first sheet, and there is no sheet on the staple tray 11, the transport motor 20 and the jam timer $T_4$ are started, and the upper discharge roller 22 is rotated in the direction of A by controlling the upper discharge motor 24 (S21). Thereafter, if a predetermined time set by the timer $T_1$ has passed (S22), the upper discharge roller 22 is rotated in the reversed direction B (S23). A predetermined time is set by the timer $T_1$ to be a time interval required for the sheets to pass between the transport rollers 4 and 5 after being detected by the feed sensor 6.

By the operations in S18 through S23, a switching back transportation of the sheets onto the staple tray 11 is supported. Namely, first, the leading edge of the sheet transported through the sheet transport path 1 is guided in the discharge direction by rotating the upper discharge roller 22 in the direction of A (inverted direction), and the sheet transportation through the sheet transport path 1 is supported. After the trailing edge of the sheet passes between the transport rollers 4 and 5, the sheet is dropped onto the staple tray 11 by its dead weight, and by rotating the upper discharge roller 22 switched in the direction of B (positive direction), the sheet is moved to the sheet trailing edge positioning plate 12. Additionally, sheet jamming is detected, if occurred, based on a timing at which the feed sensor 6 is switched ON and OFF and a time set by the jam timer $T_4$. Then, if the feed sensor 6 is not set OFF within a predetermined time, the sequence moves onto S10.

Next, when the staple tray sheet sensor 13 is set ON and the first sheet is placed on the staple tray 11 (S24), the upper discharge roller 22 is stopped (S25). Then, the timer $T_1$ is stopped and reset (S26), and the sequence moves back to S18, and the apparatus is set in the standby state for the following sheet.

Figure 10:
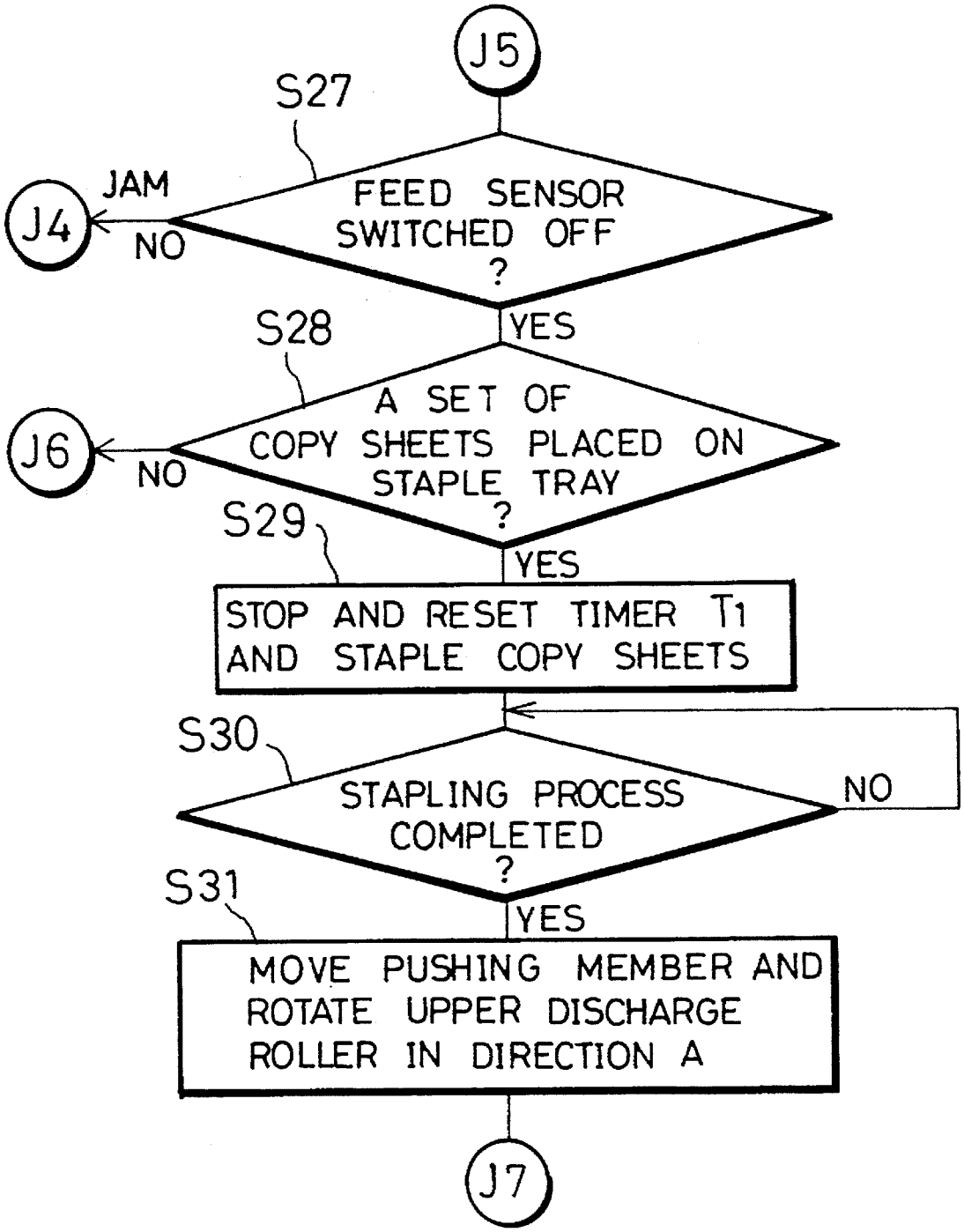

As to the following sheet, when the sheet is transported into the apparatus (S18), the sequence moves onto S27 shown in FIG. 10 through S19 and S20, and sheet jamming is detected based on a time set by the jam timer $T_4$ and a timing at which the feed sensor 6 is switched ON/OFF.

When a predetermined number of sheets are stacked on the staple tray 11 (S28), the stapling process is carried out by the stapler 14 (S29). Then, after the stapling process is completed (S30), the pusher motor 19 is controlled so as to move the pushing member 15 in the direction of C, and the upper discharge roller 22 is rotated in the direction of A (S31). As a result, a stapled set of sheets on the staple tray 11 is pushed by the pushing member 15 to be discharged onto the stacking tray 16. Here, the movement of the set of sheets is supported by the upper discharge roller 22 being rotated in the direction of A (inverted direction).

Figure 11:
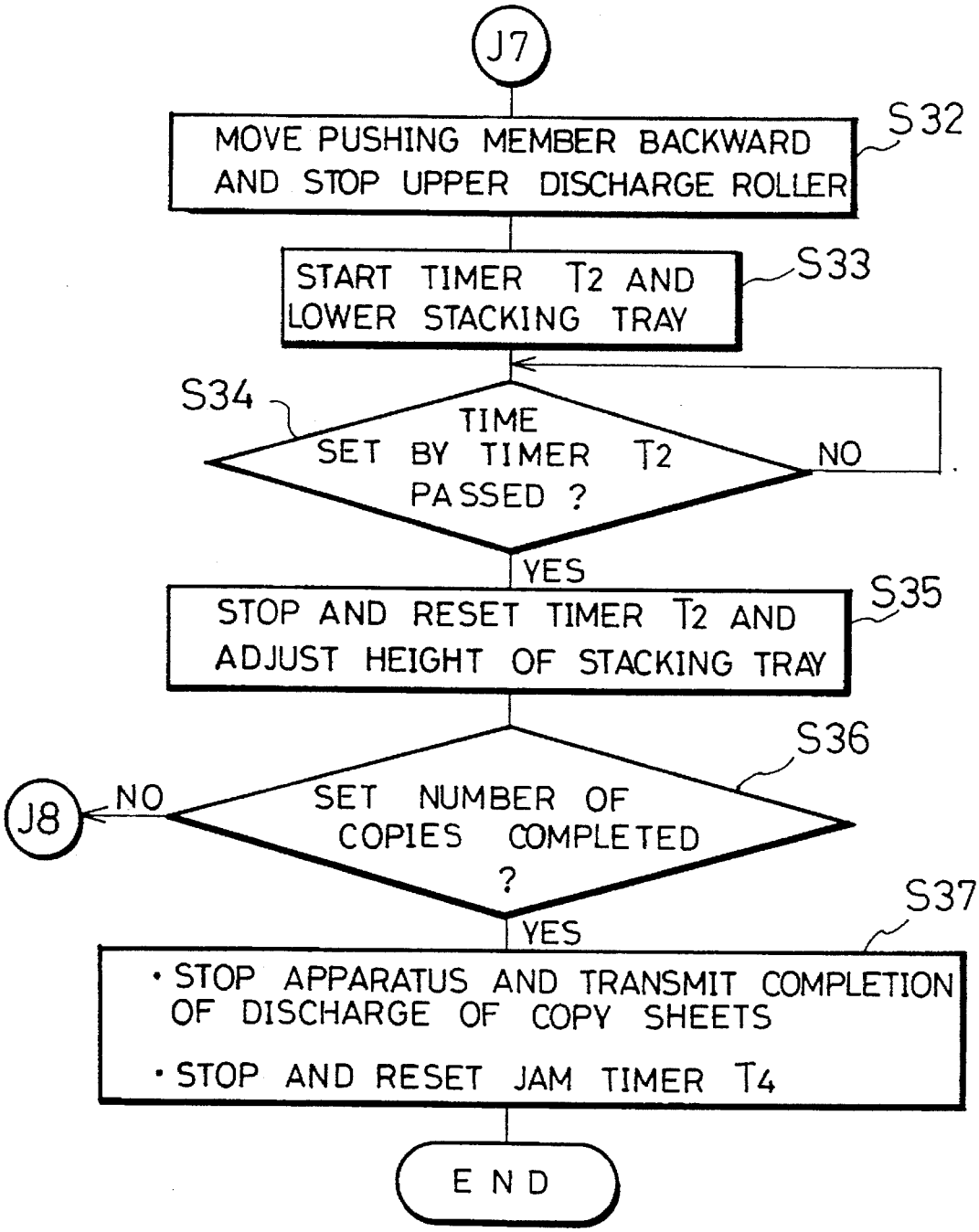

In S32 shown in FIG. 11, the pushing member 15 is moved backward to be set back to the home position. The above state is detected by the pushing member home sensor 47 (see FIG. 6). Additionally, when the pushing member 15 is moved backward, the upper discharge roller 22 is stopped (S32).

While the operation in S32 is being carried out, the timer $T_2$ for setting a timing for switching the elevator motor 33 (see FIG. 6) is started, and the elevator motor 33 is controlled so as to lower the stacking tray 16 (S33).

When the time set by the timer $T_2$ has passed (S34), since the stapled set of sheets is discharged onto the stacking tray 16, the timer $T_2$ is stopped and reset, and the elevator motor 33 is inverted, and the stacking tray 16 is raised until the tray upper limit sensor 34 is set ON so as to adjust the height of the stacking tray 16 (S35).

Thereafter, the processes in and after S18 (see FIG. 9) are repeated (S36), and when a predetermined number of copies is completed, the operation of the apparatus is stopped and the jam timer $T_4$ is reset and the information indicating that a discharge of the copy sheet is completed is transmitted to the copying machine main body (S37), thereby terminating the operation. In the meantime, if sheet jamming occurs, the operation is stopped in S10, and the information indicating that sheet jamming occurred is transmitted to the copying machine main body.

As described, the sheet post-processing apparatus of the present embodiment is arranged such that in the non-staple mode, a sheet is discharged by passing between the upper and lower discharge rollers 22 and 23. On the other hand, in the staple mode, a stapled set of sheets is discharged through the discharge opening 37 formed on the upper discharge roller 22. Here, relative position between the upper discharge roller 22 and the lower discharge roller 23 is not moved. Thus, the upper discharge roller 22 and the lower discharge roller 23 are in contact with one another at a constant pressure throughout the discharge process of the sheet. Therefore, in the non-staple mode, sheets are not likely to be stuck between the the upper and the lower discharge rollers 22 and 23. Moreover, the sheets are not likely to be slanted when being discharged through the discharge rollers 22 and 23, thereby achieving a stable discharge of the sheet.

Moreover, the upper transport roller 4 is provided at such a position that the line connecting the center of the transport roller 4 and the transport roller 5 forms an angle θ to the vertical line towards the entry opening 1*c*. Therefore, in the non-staple mode, a sheet placed between the transport rollers 4 and 5 is surely directed so as to pass between the upper and lower discharge rollers 22 and 23, and the sheet can be desirably discharged onto the stacking tray 16. In the staple mode, the trailing edge of the sheets being discharged by passing between the transport rollers 4 and 5 can be easily dropped onto the staple tray 11, thereby desirably carrying out the discharge of the sheets onto the staple tray 11 through the sheet transport path 1.

With the control of the upper discharge roller 22, in the non-staple mode, the upper discharge roller 22 is rotated in the direction of B (positive direction), i.e., in the direction of the sheets being discharged by passing between the upper and lower discharge rollers 22 and 23 onto the stacking tray 16. On the other hand, in the staple mode, when the sheets are discharged by passing between the transport rollers 4 and 5, the upper discharge roller 22 is rotated in the direction of A (inverted direction), i.e., in the direction of the sheet dropped on the upper discharge roller 22 to be discharged onto the stacking tray 16 to be temporarily held therein. On the other hand, when the trailing edge of the sheet becomes apart from the transport rollers 4 and 5, the upper discharge roller 22 is rotated in the direction of the sheet being transported by the sheet trailing edge positioning plate 12 of the staple tray 11, i.e., in the direction of B (positive direction). Furthermore, when the stapled set of sheets is discharged by the pushing member 15, in order to support the sheet being pushed up over the upper discharge roller, the upper discharge roller 22 is rotated in the direction of the sheet being discharged onto the stacking tray 16, i.e., in the direction of A (inverted direction). As described, in the staple mode, in order to support the sheets being transported by the upper discharge roller 22, sheet jamming due to the surface resistance of the upper discharge roller 22 and the staple tray 11 will not occur, and a desirable transportation of sheets can be achieved.

As the remover brush 10 is moved to the optimal position according to respective sections for discharging sheets therethrough in the non-staple mode and the staple mode, a charge on the sheet can be desirably removed in both modes, and a desirable alignment of the sheets on the stacking tray 16 can be ensured. In the present embodiment, the remover brush 10 is secured to the movable sheet guide 7 via the brush support member 9, and so as to be integrally driven by the sheet guide displacement motor 8 with the movable sheet guide 7. However, it may be arranged such that the remover brush 10 is provided separately from other members and is driven by the drive means separately from the sheet guide displacement motor 8.

The following description will discuss another embodiment of the present invention with reference to FIGS. 12 through 16. For convenience, members having the same function as in the first embodiment will be designated by the same code and their description will be omitted. The respective flow charts of FIG. 14 and FIG. 16 follow the flow chart of FIG. 7 used in explaining the first embodiment.

Figure 12:
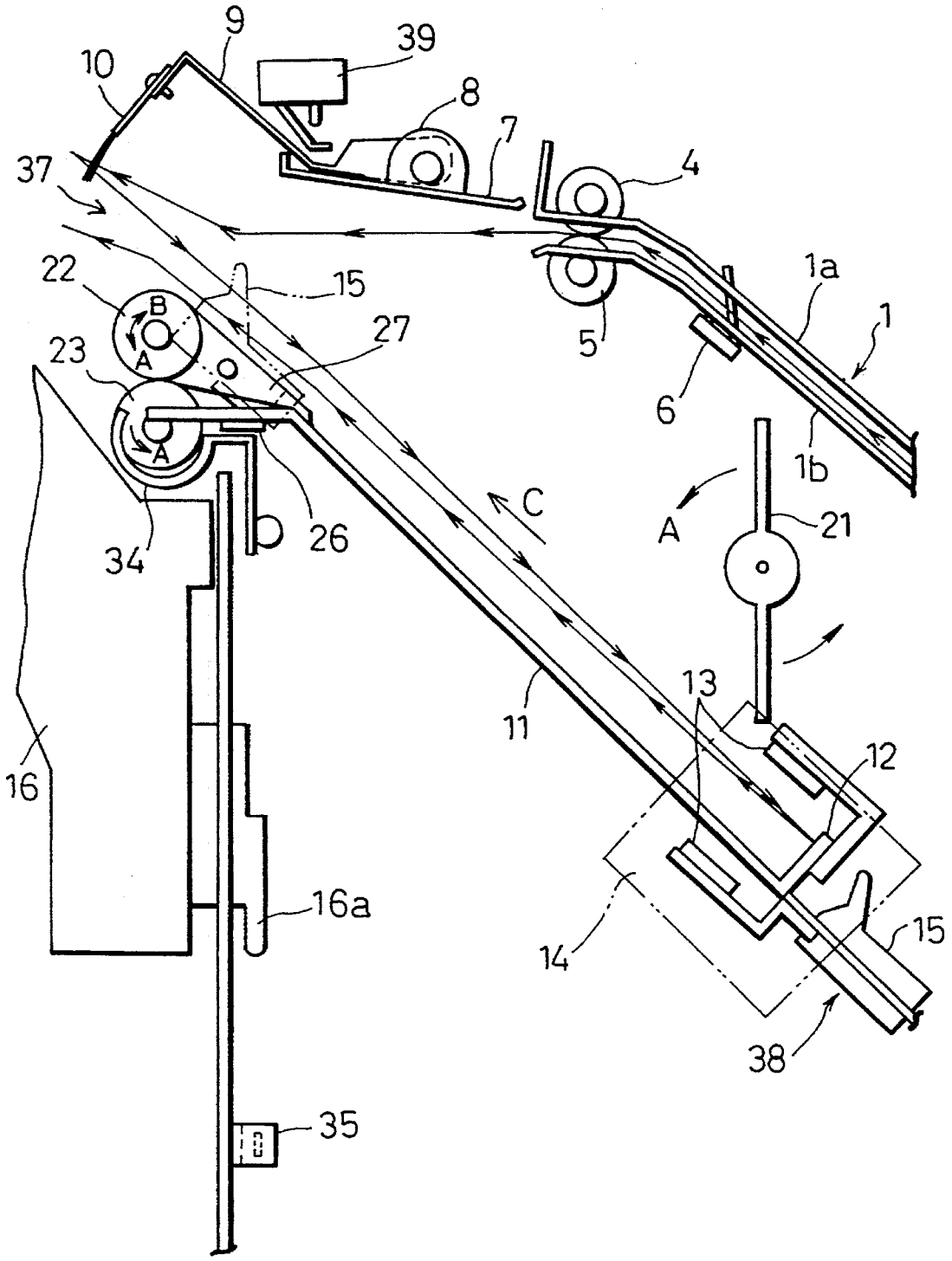
Figure 13:
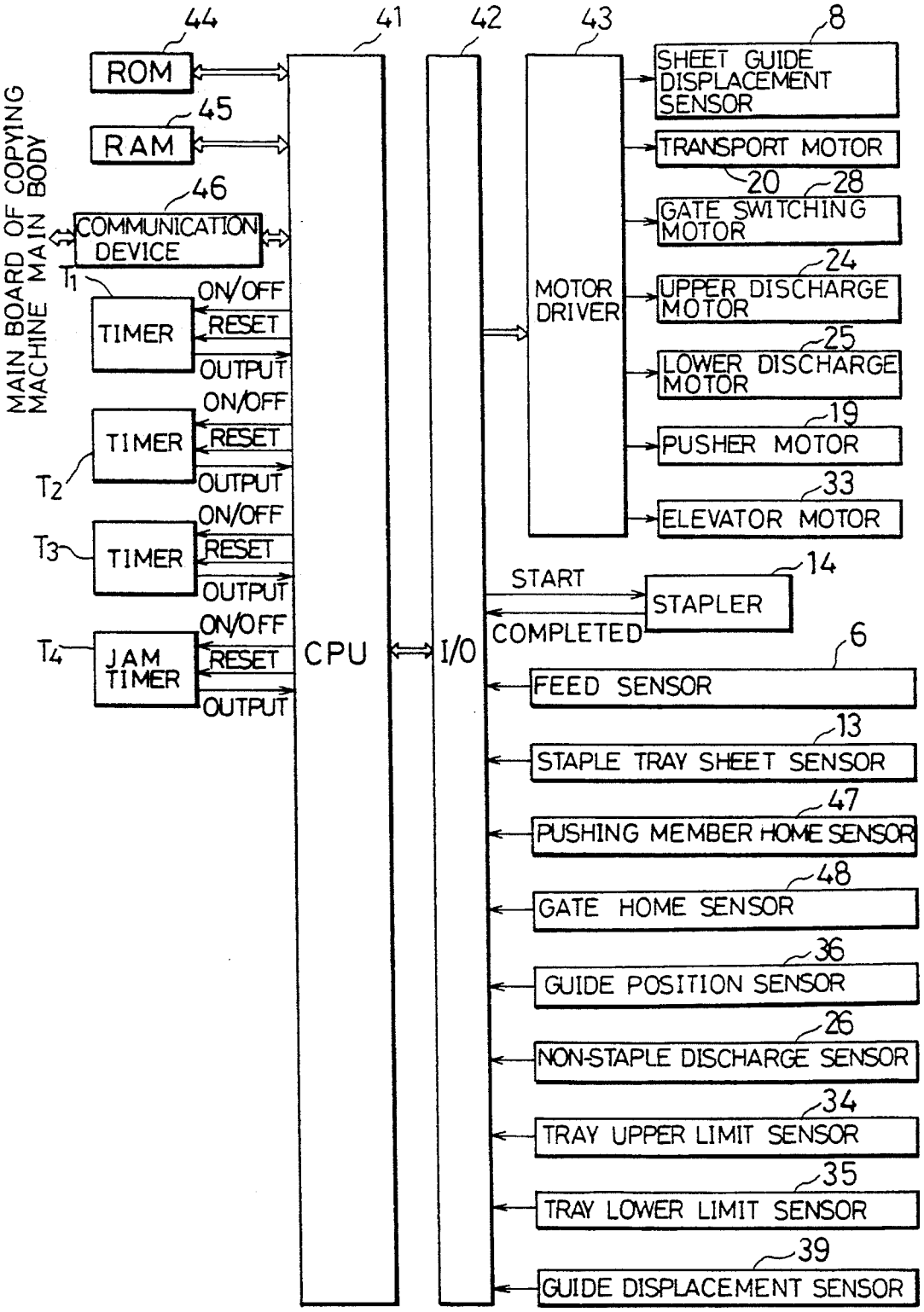

As shown in FIG. 12, a sheet post-processing apparatus of the present embodiment is provided with a guide displacement sensor 39 (sheet guide member displacement detection means) placed above a movable sheet guide 7. The guide displacement sensor 39 is arranged such that in the staple mode, it is set ON when the sheet being transported through a sheet transport path 1 is jammed and the movable sheet guide 7 is moved still upward from the staple mode position, thereby detecting sheet jamming. As shown in FIG. 13, the guide displacement sensor 39 is connected to the CPU 41 through an input-output interface 42.

Figure 14:
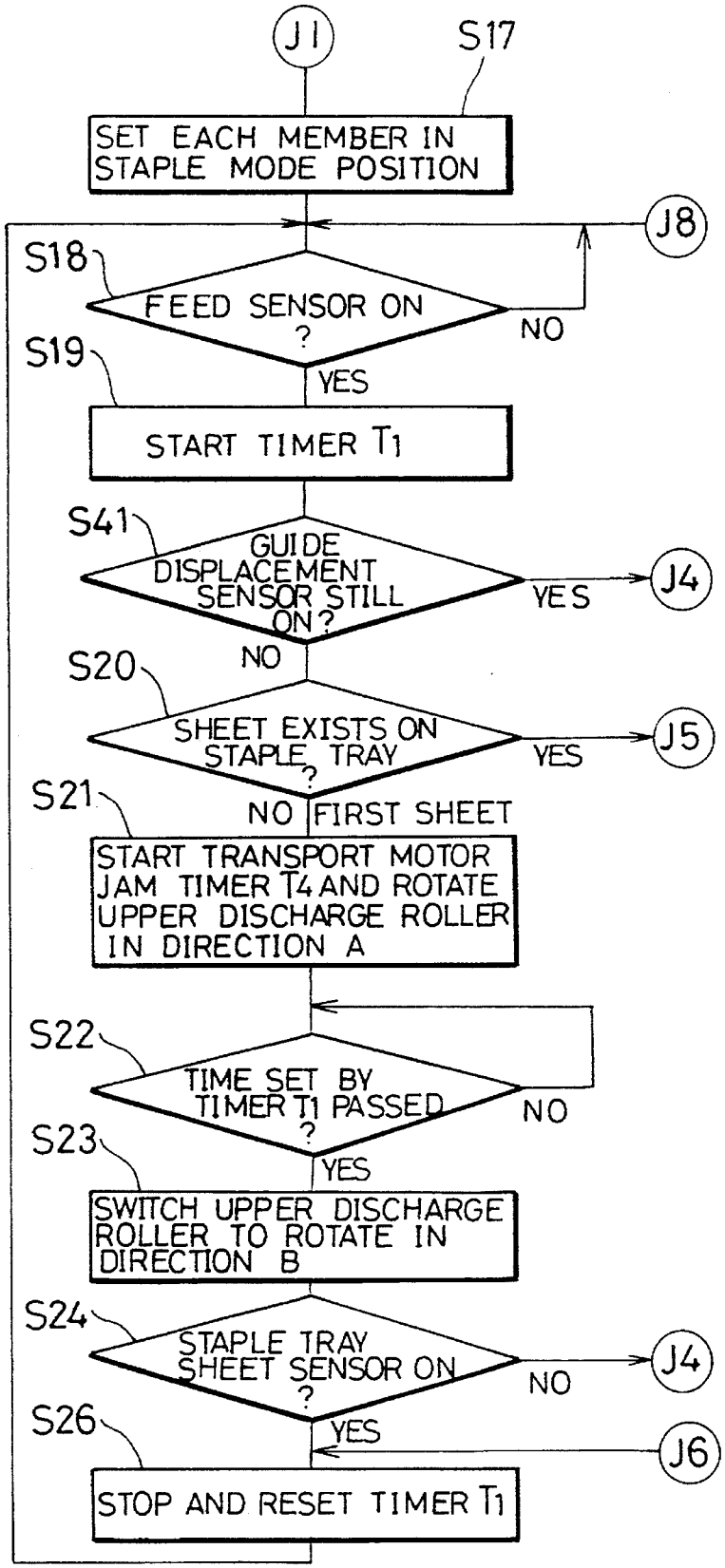
Figure 15:
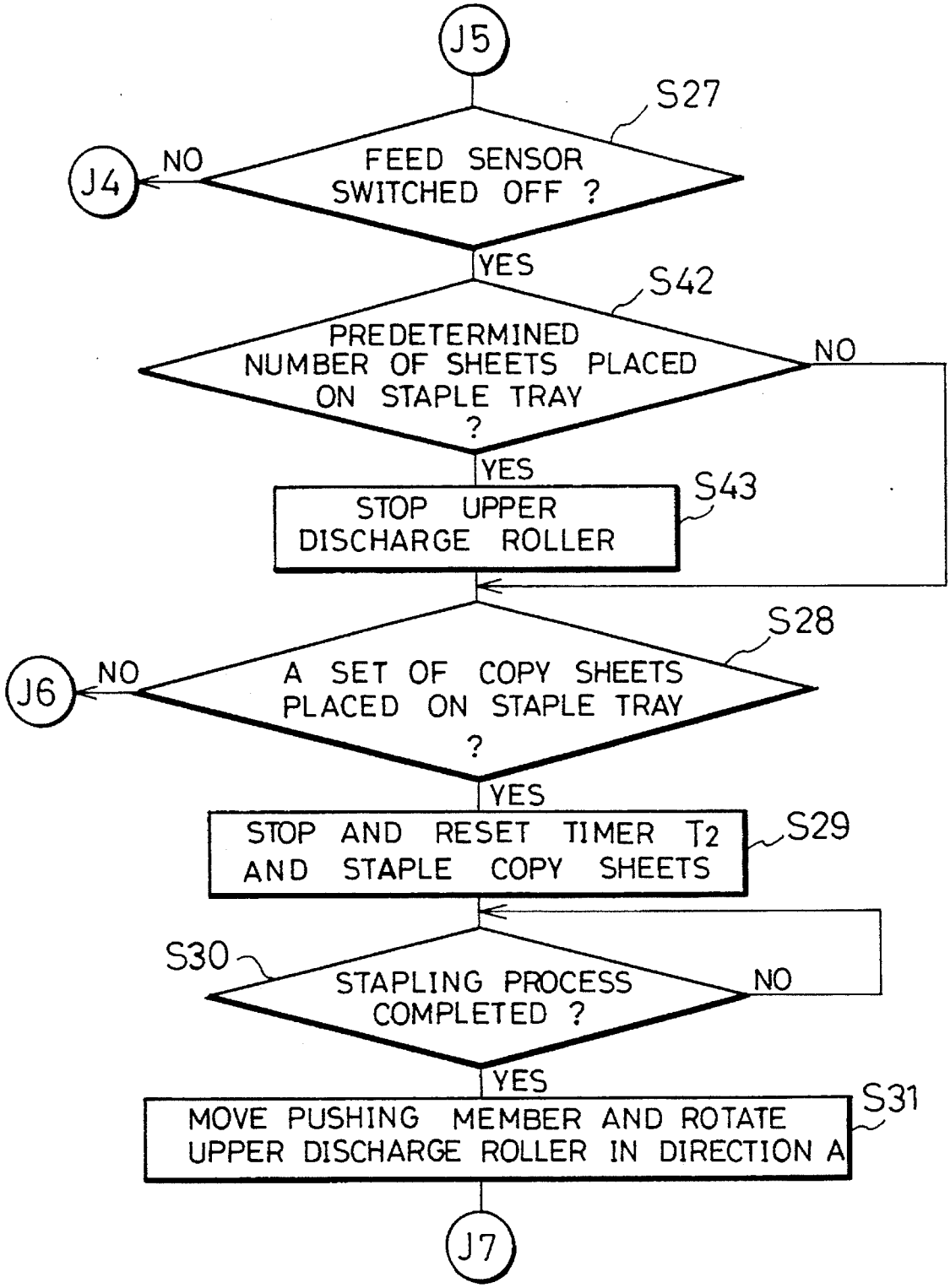

In the operation of the sheet post-processing apparatus of the present embodiment, as described in S41 of FIG. 14 corresponding to FIG. 9 used in the explanation of the previous embodiment, in the staple mode, every time the sheet is transported through the sheet transport path 1, it is confirmed that the guide displacement sensor 39 is set ON or OFF. Here, if the guide displacement sensor 39 is set OFF, the sequence moves onto S20, while if the guide transition sensor 39 remains ON, the sequence moves onto S10 of FIG. 8 and the operation is stopped; in the meantime, information indicating that sheet jamming occurred is transmitted to the copying machine main body. In the above arrangement, the occurrence of sheet jamming on a staple tray 11 occurred, for example, when transporting the sheets into the apparatus can be accurately detected.

As shown in FIG. 14, the sheet post-processing apparatus of the present embodiment is arranged such that in the staple mode, even after the first sheet is placed on the staple tray 11 (S24), an upper discharge roller 22 continues rotating in the direction of B. Namely, without an operation in S25 of FIG. 9, the upper discharge roller 22 is kept rotating in the direction of B. Thereafter, the sequence moves from S20 to S42 through S27 of FIG. 15, and the following sheet is placed on the staple tray 11, and when a predetermined number of sheets are stacked on the staple tray 11, the upper discharge roller 22 is stopped rotating in S43.

As described, as the upper discharge roller 22 continues rotating in transporting the following sheet, a vibration from the rotation is transmitted to the sheet, thereby achieving a desirable alignment of the sheets on the staple tray 11.

Moreover, as the upper discharge roller 22 is stopped rotating when a predetermined number of sheets are placed on the staple tray 11, a transport force of the upper discharge roller 22 is not increased by the weight of the sheets, thereby preventing the bottom sheet from being damaged, for example, by being creased even in the case of transporting a large number of sheets.

A predetermined number of sheets to be placed on the staple tray 11 based on which the rotation of the upper discharge roller 22 is stopped is to be set by the weight of the sheets placed on the staple tray 11. Thus, the predetermined number of sheets changes according to the size of the sheet. For example, for an A-4 size sheet, it should be 10 or so.

In the sheet post-processing apparatus, in order to prevent the sheets being discharged onto the stacking tray 16 from having dust adhering thereto or being damaged by being contact with the lower discharge roller being rotated, the rotation of a lower discharge roller 23 is controlled as follows.

Figure 16:
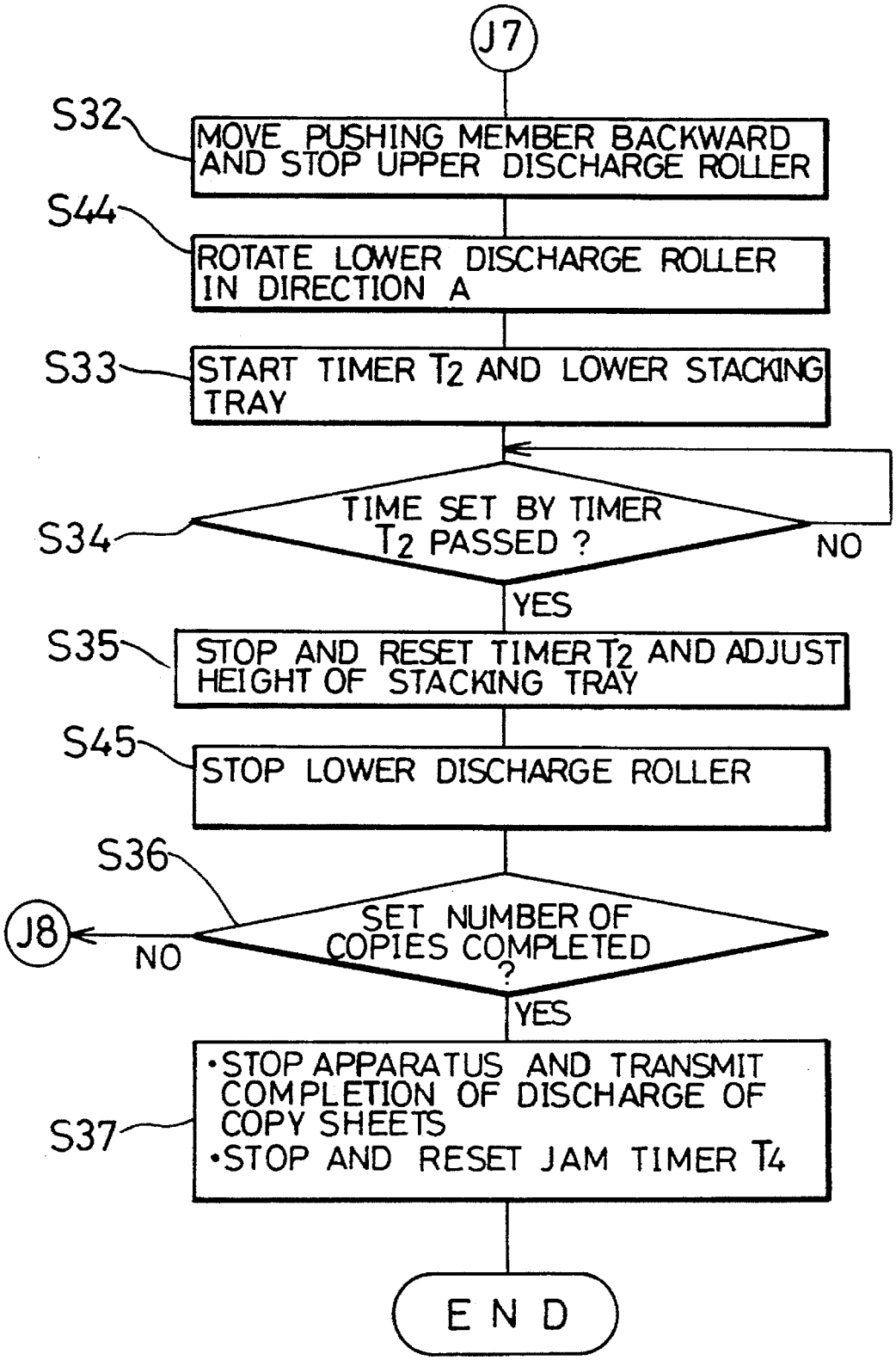

In the non-staple mode, the lower discharge roller 23 discharges the sheets together with the upper discharge roller 22. Therefore, the lower discharge roller 23 starts rotating in the direction of A when the leading edge of the first sheet is detected by a non-staple discharge sensor 26 in the case of a successive copying operation, and the rotation of the lower discharge roller 23 is stopped when the last sheet is discharged indicative of the completion of the sequential copying process. In the staple mode, the lower discharge roller 23 does not affect the discharge of the sheet, and the lower discharge roller 23 is rotated so as to align stapled sets of sheets discharged onto the stacking tray 16 at a position opposite to the discharge direction. Therefore, as shown in FIG. 16, in S44, in synchronous with the backward movement of the pushing member 15 after discharging the sheet, the lower discharge roller 23 starts rotating in the direction of A, and in S45, the height of the stacking tray 16 is adjusted, and then the rotation is stopped.

As described, in the sheet post-processing apparatus of the present embodiment, the rotating time of the lower discharge roller 23 can be kept minimum both in the non-staple mode and the staple mode. Namely, the lower discharge roller 23 is rotated only while the sheet discharge operation onto the stacking tray 16 is being carried out, thereby preventing the sheet from being dusted or damaged due to the rotation of the lower discharge roller 23.

The following description will discuss still another embodiment of the present invention with reference to FIG. 17 through FIG. 23. For convenience, members having the same function as in the previous embodiments will be designated by the same code and their description will be omitted. Here, the respective flow charts of FIG. 21 through FIG. 23 follow the flow chart of FIG. 7 used in explaining the first embodiment.

Figure 17:
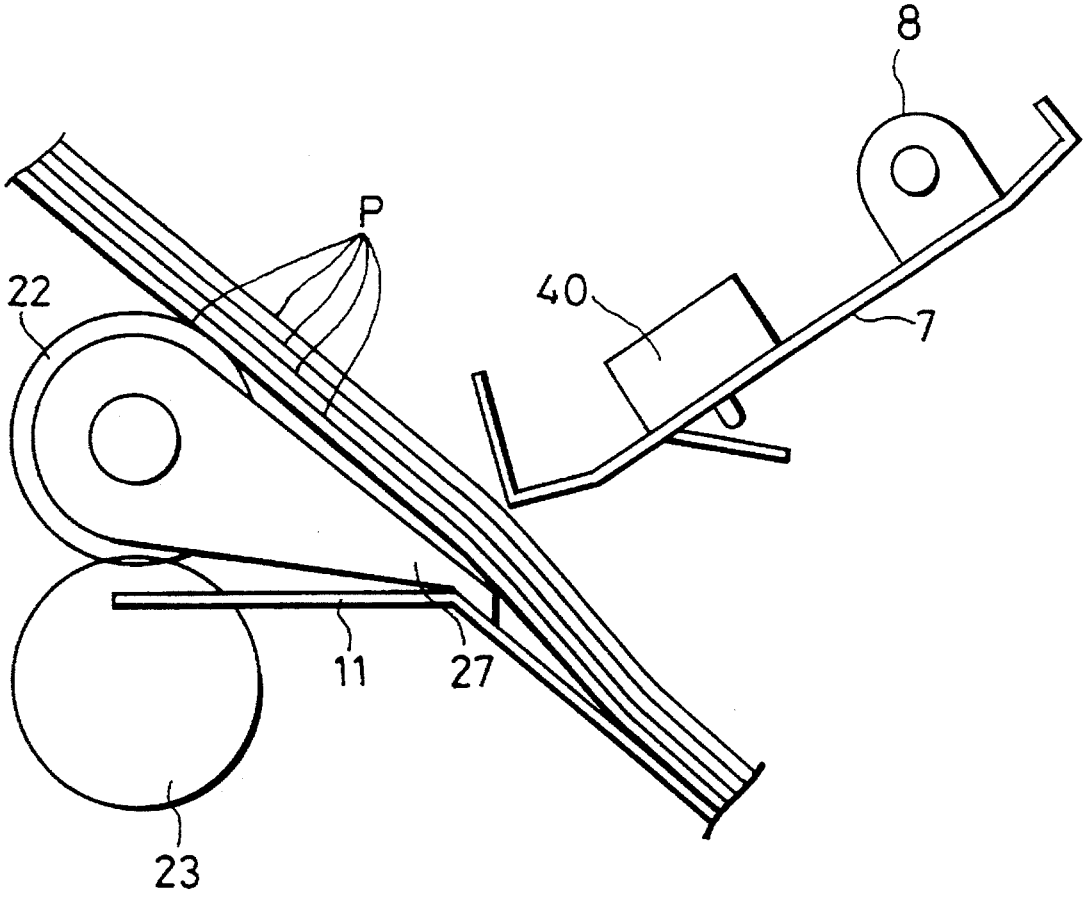
Figure 18:
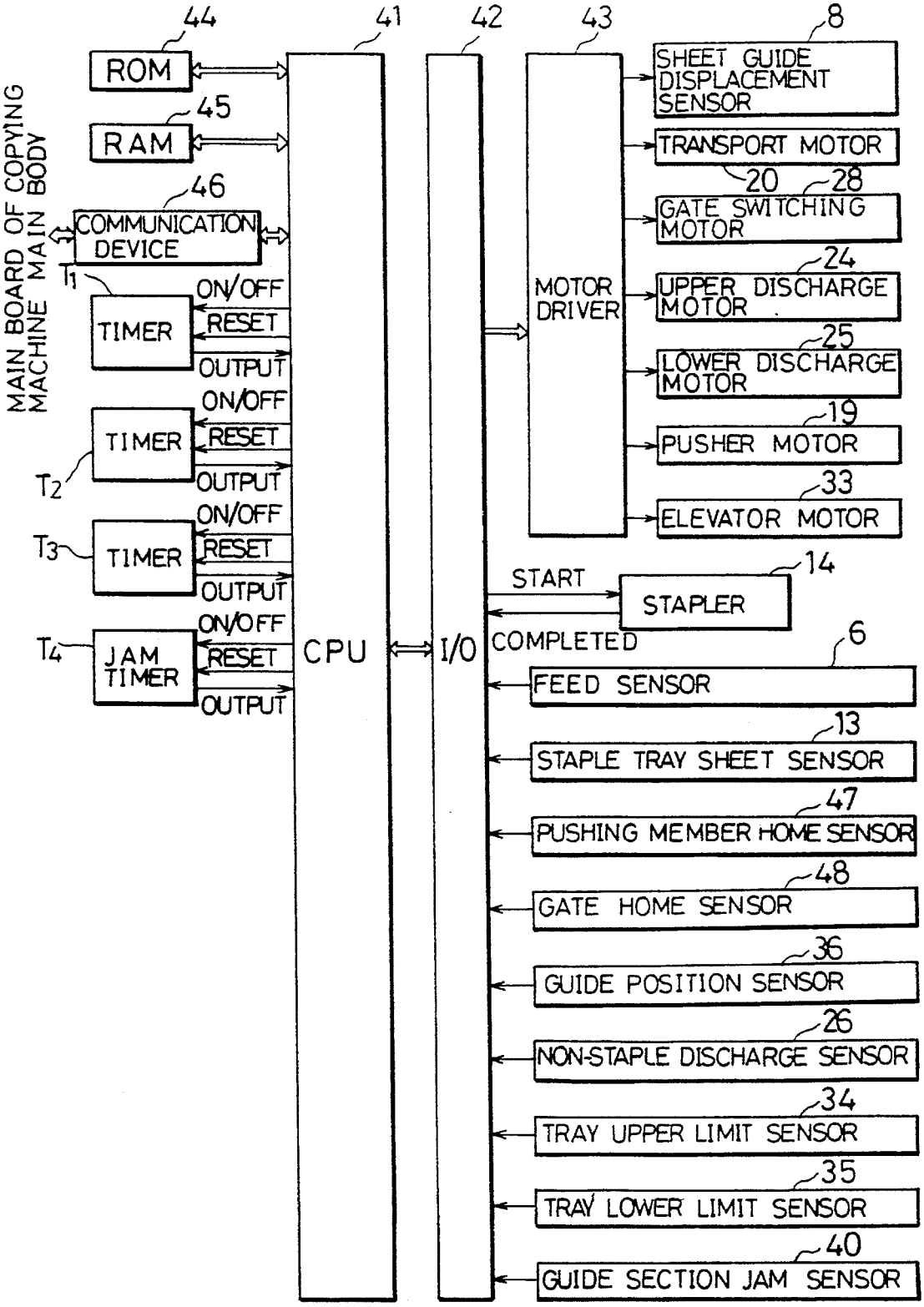

As shown in FIG. 17, the sheet post-processing apparatus of the present embodiment is arranged such that a movable sheet guide 7 is provided with a guide section jam sensor 40 (discharge failure detection means) for detecting sheet jamming occurred when the sheet is pushed out by a pushing member 15. The guide section jam sensor 40 is provided so as to be set ON by a sheet P to be buckled on the bottom surface side of a movable sheet guide 7. As shown in FIG. 18, the guide section jam sensor 40 is connected to a CPU 41 through an input output interface 42.

In order to improve the transporting speed of the sheets, sheet post-processing apparatus of the present embodiment controls the movable sheet guide 7 as explained below.

Figure 19:
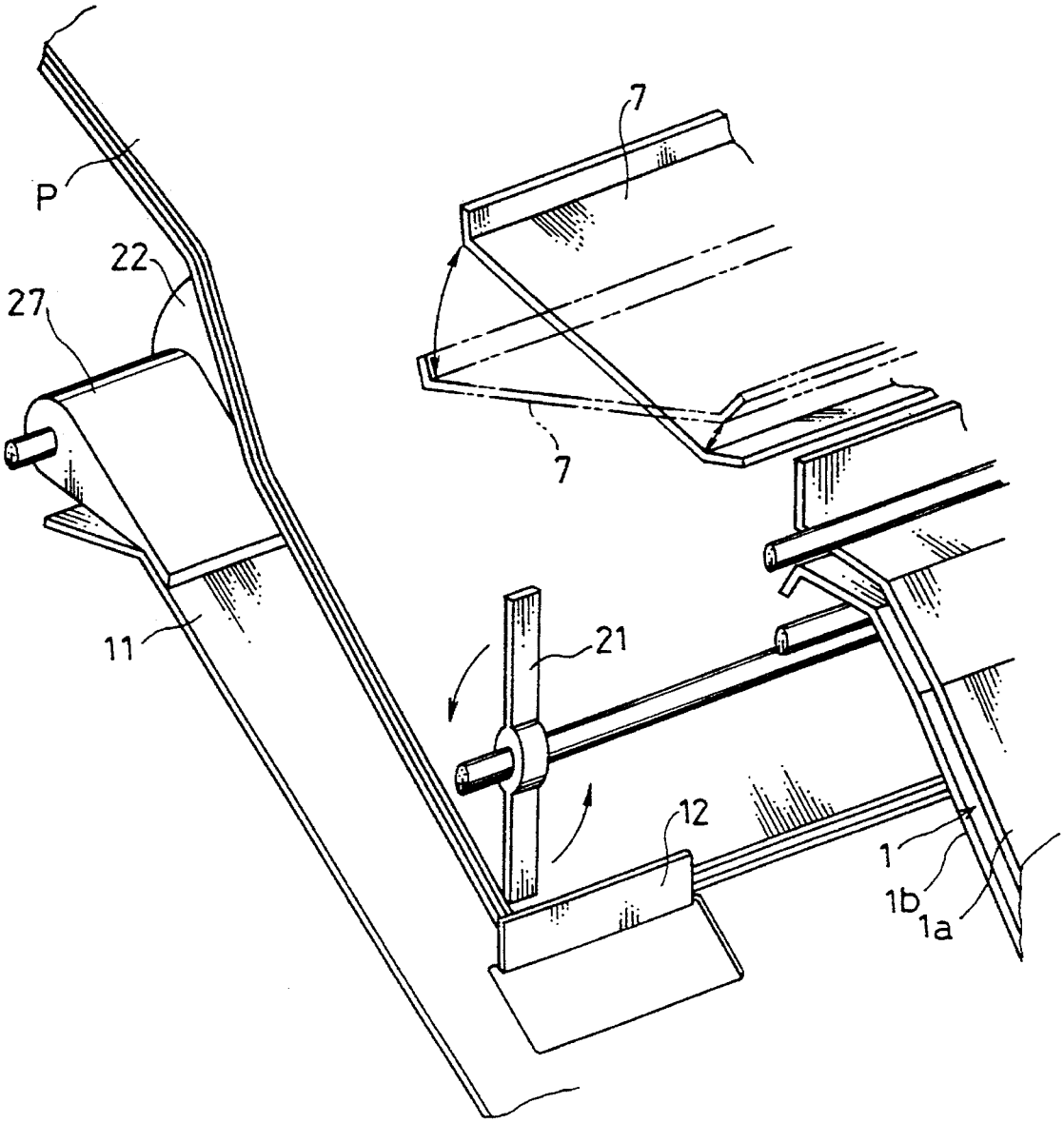
Figure 21:
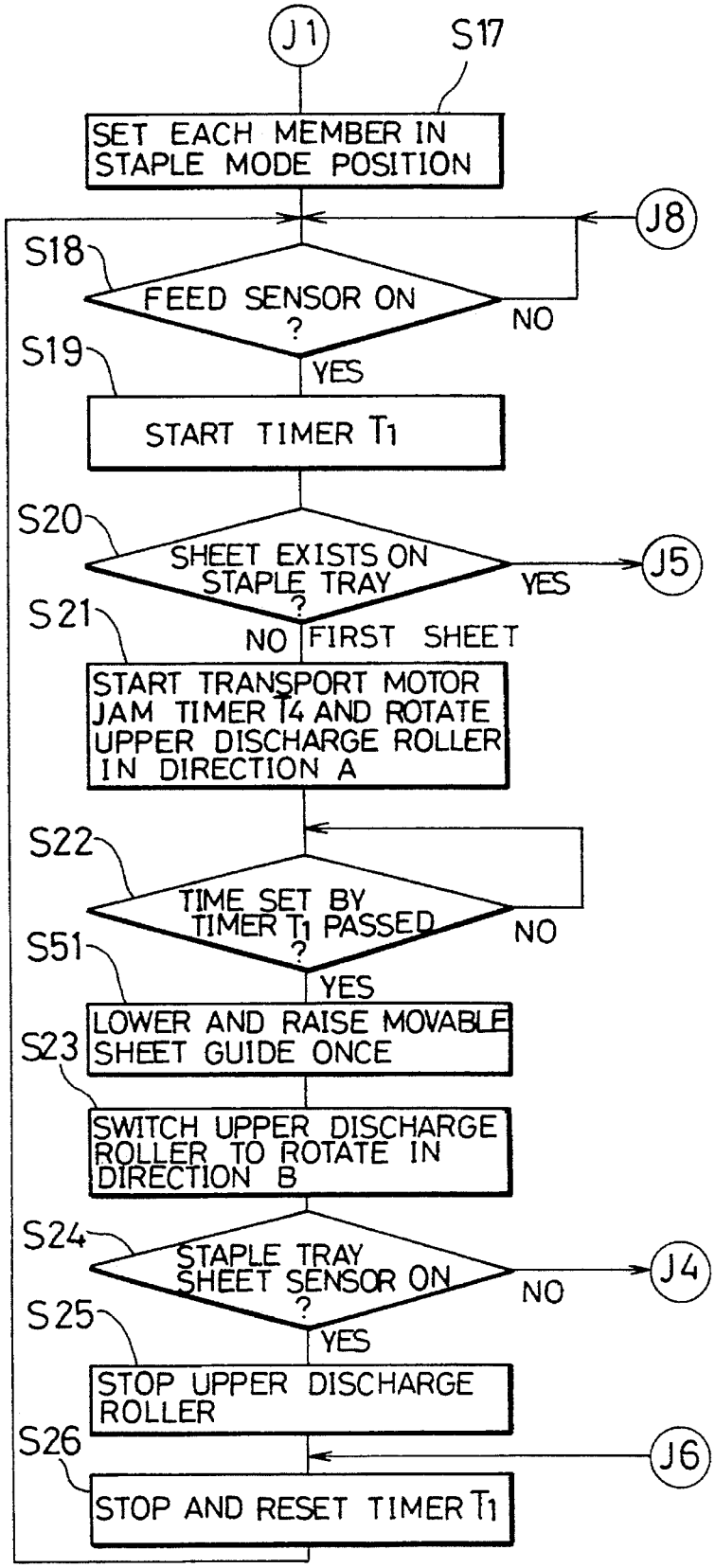

In the sheet post-processing apparatus of the present embodiment, as shown in S51 in FIG. 21 corresponding to FIG. 9 which explains the previous embodiment, when a time set by a timer $T_1$ has passed (S22) and the first sheet passes between the transport rollers 4 and 5, a sheet guide displacement motor 8 is controlled so as to move the movable sheet guide 7 in the staple mode position to be moved temporarily downward as shown by the two-dot long and two short dashes line in FIG. 19 and immediately raised back to the original position. Here, the movable sheet guide 7 is moved downward, for example, to the non-staple mode position. Then, the above operations are also carried out for the following sheets as explained in S52 and S53 of FIG. 22 corresponding to FIG. 10.

With the above operation of the movable sheet guide 7, the sheet being transported through the sheet transport path 1 is immediately dropped onto a staple tray 11, thereby improving the transporting speed of the sheet.

Additionally, in the present embodiment, in order to prevent sheet jamming occurred when the sheet is being pushed out by the pushing member 15, the movable sheet guide 7 is controlled as explained below.

Figure 22:
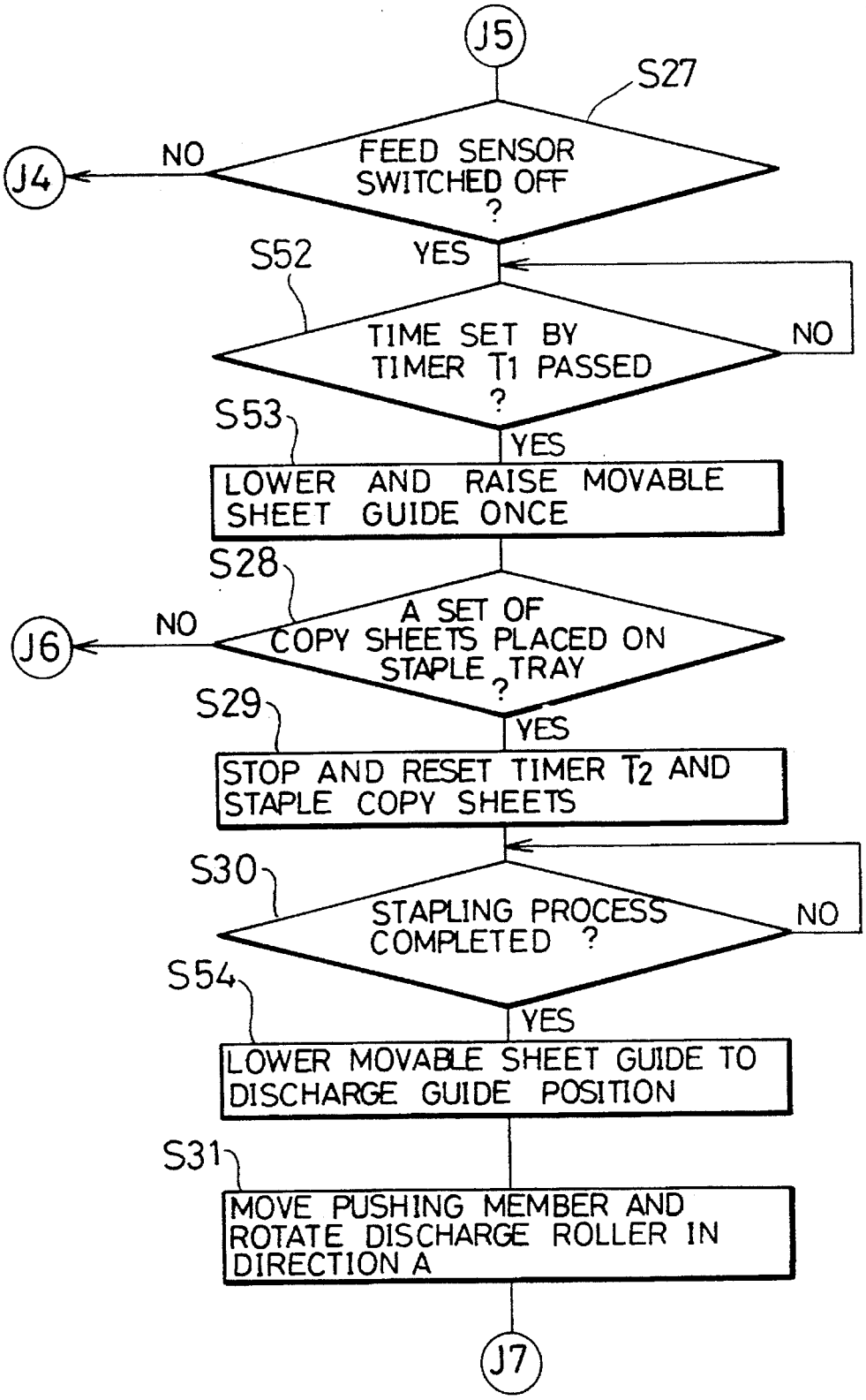
Figure 23:
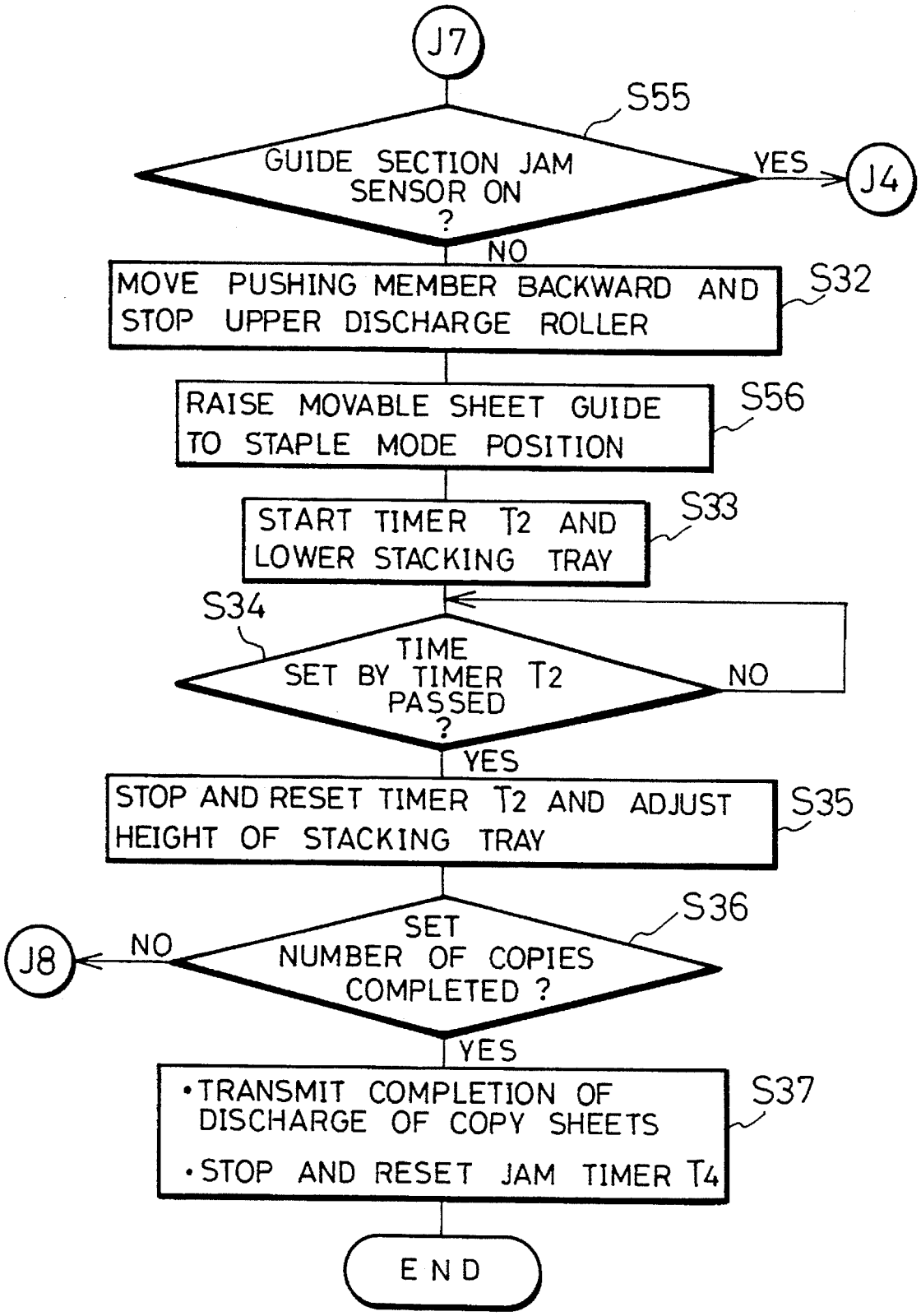

As shown in S54 of FIG. 22, after the stapling process is carried out on the sheets placed on the staple tray 11 (S30), the sheet guide displacement motor 8 is controlled. Then, the movable sheet guide 7 is moved downward from the staple mode position to a discharge guide position shown in FIG. 17 and FIG. 20. The position of the movable sheet guide 7 is set such that the end of the movable sheet guide 7 is almost in contact with the leading edge of the sheet on the staple tray 11. After the sheets have been pushed out onto the stacking tray 16 by the pushing member 15, the movable sheet guide 7 is moved back to the staple mode position in S56 of FIG. 23 as the pushing member 15 is moved backward.

With the operation of the movable sheet guide 7, an upward buckling of the sheet being pushed out by the pushing member 15 can be prevented. As a result, in the case of stapling few number of sheets or stapling fairly thin sheets, the sheets can be desirably pushed out onto a stacking tray 16.

Figure 20:
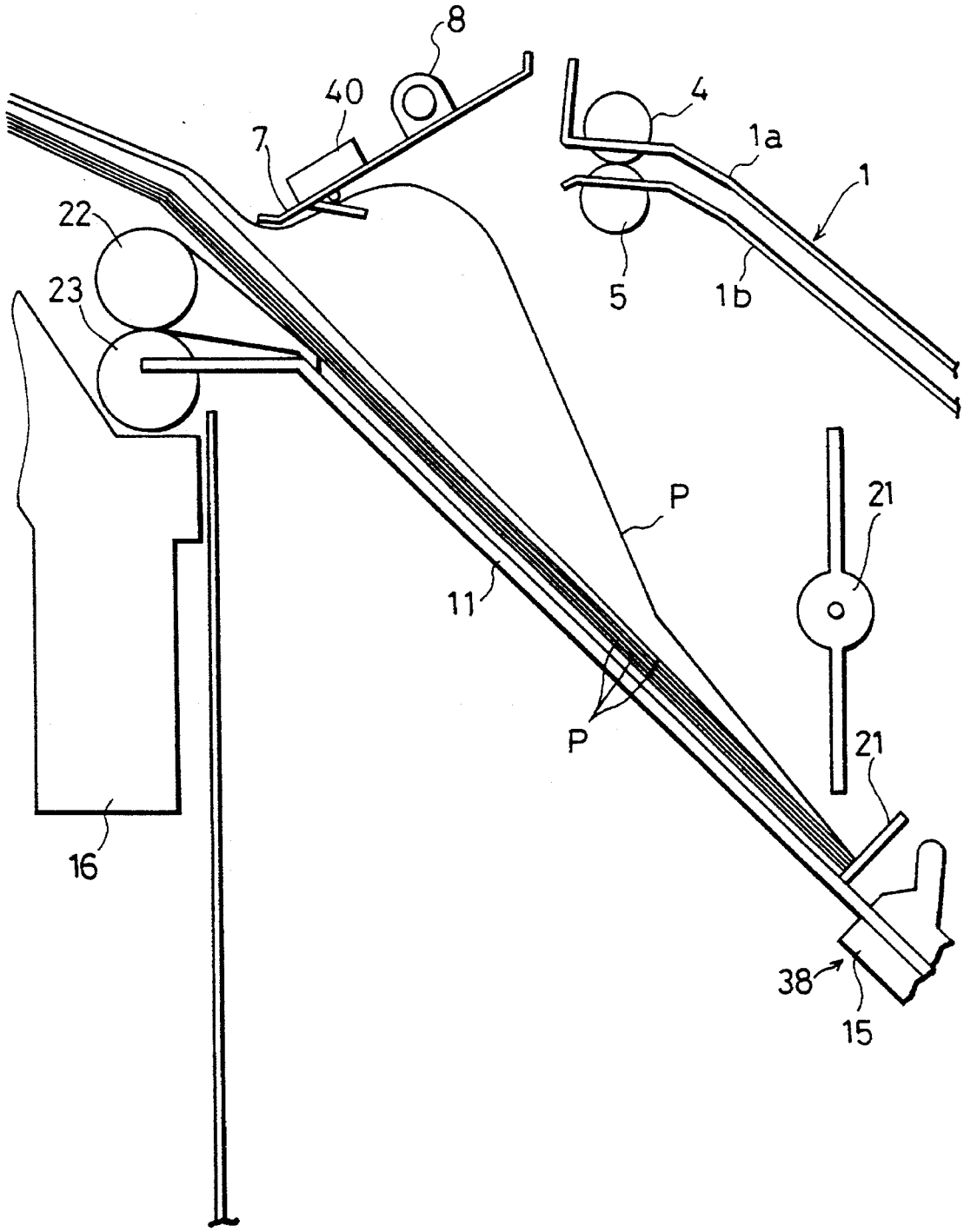

As shown in FIG. 20, when pushing out the sheets along the staple tray 11 by the pushing member 15, if a top sheet is buckled upward, i.e., when sheet jamming occurred, the guide section jam sensor 40 is set ON by being pushed by the buckled sheet. In this case, as explained in S55 of FIG. 23, the sequence is moved onto S10 of FIG. 8, and information indicating that sheet jamming occurred is sent to the copying machine main body. In the above arrangement, sheet jamming occurred when pushing out the sheets can be accurately detected. As a result, the stapled set of sheets can be prevented from being badly damaged.

Since the guide section jam sensor 40 is provided, as described in the first embodiment, sheet jamming can be detected also in the case where the sheets are discharged by the pushing member 15 without moving the movable sheet guide 7 downward from the staple mode position.

In order to carry out each operation, in the sheet post-processing apparatus of the present embodiment, the remover brush 10 is not integrally provided with the movable sheet guide 7 by the brush support member 9 but provided separately.

Figure 24:
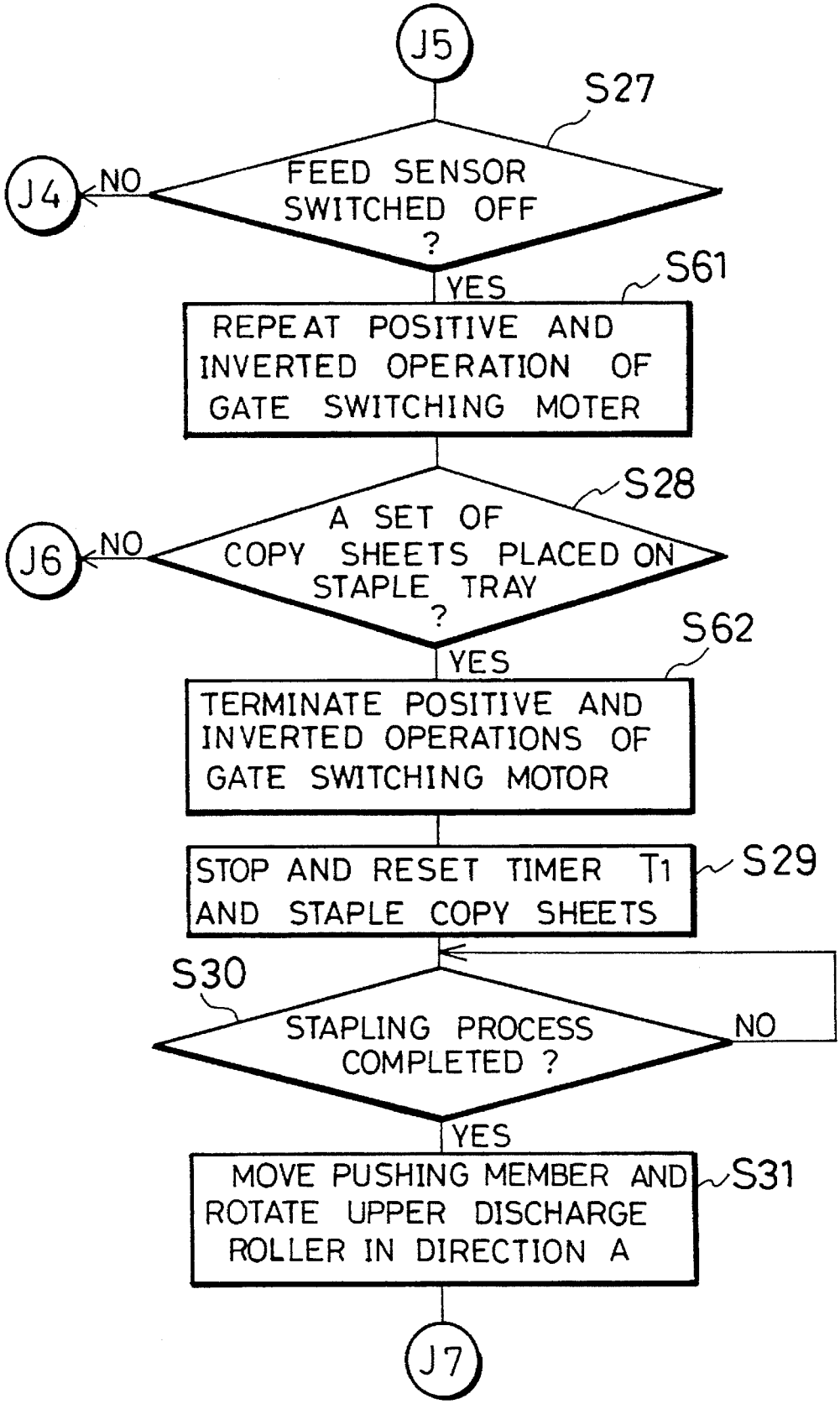
FIG. 24 which explains still another embodiment of the present invention is a flow chart showing operations of a sheet post-processing apparatus to be replaced with the operations shown in FIG. 10 in the sequential operations shown in FIG. 7 through FIG. 11.

The following description will discuss another embodiment of the present invention with reference to FIG. 4 and FIG. 24. Here, members having the same functions as those of the previous embodiment will be designated by the same reference numerals, and thus the descriptions thereof shall be omitted here.

The flow chart of FIG. 24 corresponds to the flow chart in FIG. 10 of FIG. 7 through FIG. 11 used in explaining the first embodiment.

In the sheet post-processing apparatus of the present embodiment, for the purpose that a sheet transported through the sheet transport path 1 and dropped onto the staple tray 11 can quickly reach the sheet trailing edge positioning plate 12, the gate switching motor 28 are controlled as explained below.

As shown in FIG. 24, in the staple mode, when the following sheets are transported through the sheet transport path 1 (S27), in S61, the rotating direction of the gate switching motor 28 is switched at quick interval. Thereafter, when a set of sheets to be stapled are placed on the staple tray 11 (S28), an operation of the gate switching motor 28 is terminated in S62. With the above operation by the gate switching motor 28, the gate 27 vibrates, and thus the staple tray 11 at which the leading edge of the gate 27 is made in contact therewith also vibrates and resonates as shown in FIG. 4. As the staple tray 11 vibrates, the sheet dropped on the staple tray 11 quickly reaches the sheet trailing edge positioning plate 12.

A still another embodiment of the present embodiment will be explained below in reference to FIG. 25 through FIG. 31. For convenience, members having the same function as in the previous embodiments will be designated by the same code and their description will be omitted.

Figure 25:
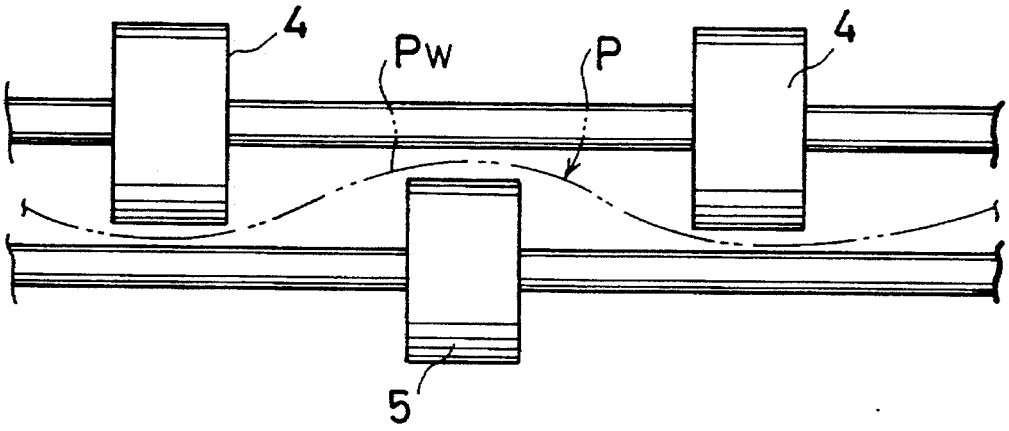

As shown in FIG. 25, the sheet post-processing apparatus of the present embodiment is provided with transport rollers 4 and 5 at respective positions displaced in a widthwise direction of the sheet without confronting each other. Therefore, the sheet P being transported by transport rollers 4 and 5 forms a buckled portion Pw in a widthwise direction orthogonal to the transport direction. As described, since the buckled portion Pw is formed in the widthwise direction of the sheet P, the sheet P is not likely to be deformed in the transport direction, and after the sheet passes between the transport rollers 4 and 5, the sheet can be smoothly guided along the movable sheet guide 7. Moreover, in the staple mode, the sheet can be smoothly dropped onto the staple tray 11 through the transport rollers 4 and 5. As a result, even in the case of transporting a thin sheet P or transporting a sheet which can be easily buckled in a sheet conveyance direction, the sheet P can be smoothly transported.

Figure 26:
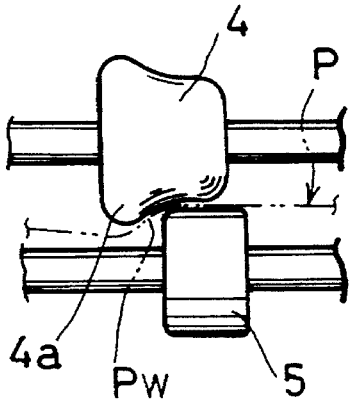
Figure 27:
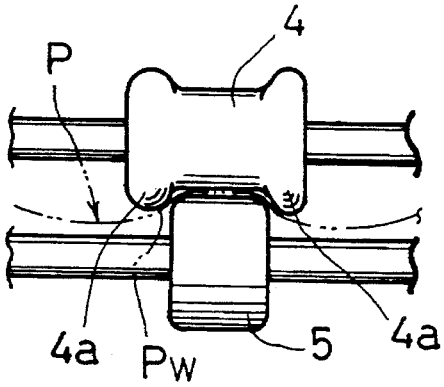

As described, the transport rollers 4 and 5 form the buckled portion Pw of the sheet P in the widthwise direction. The sheet post-processing apparatus of the present embodiment may be also arranged such that the transport rollers 4 and 5 are placed so as to face one another in order to from a buckled portion Pw of the sheet P in a widthwise direction. As shown in FIG. 26, a section 4*a* of a large diameter may be provided on one peripheral portion of the transport roller 4 so as to be projected to one side of the transport roller 5, or sections 4*a* may be provided on both peripheral portions of the transport roller 4 so as to be projected to both sides of the transport roller 5 as shown in FIG. 27. Namely, the respective arrangements of the transport rollers 4 and 5 are not limited as long as a buckled portion Pw can be formed in the sheet P.

Figure 28:
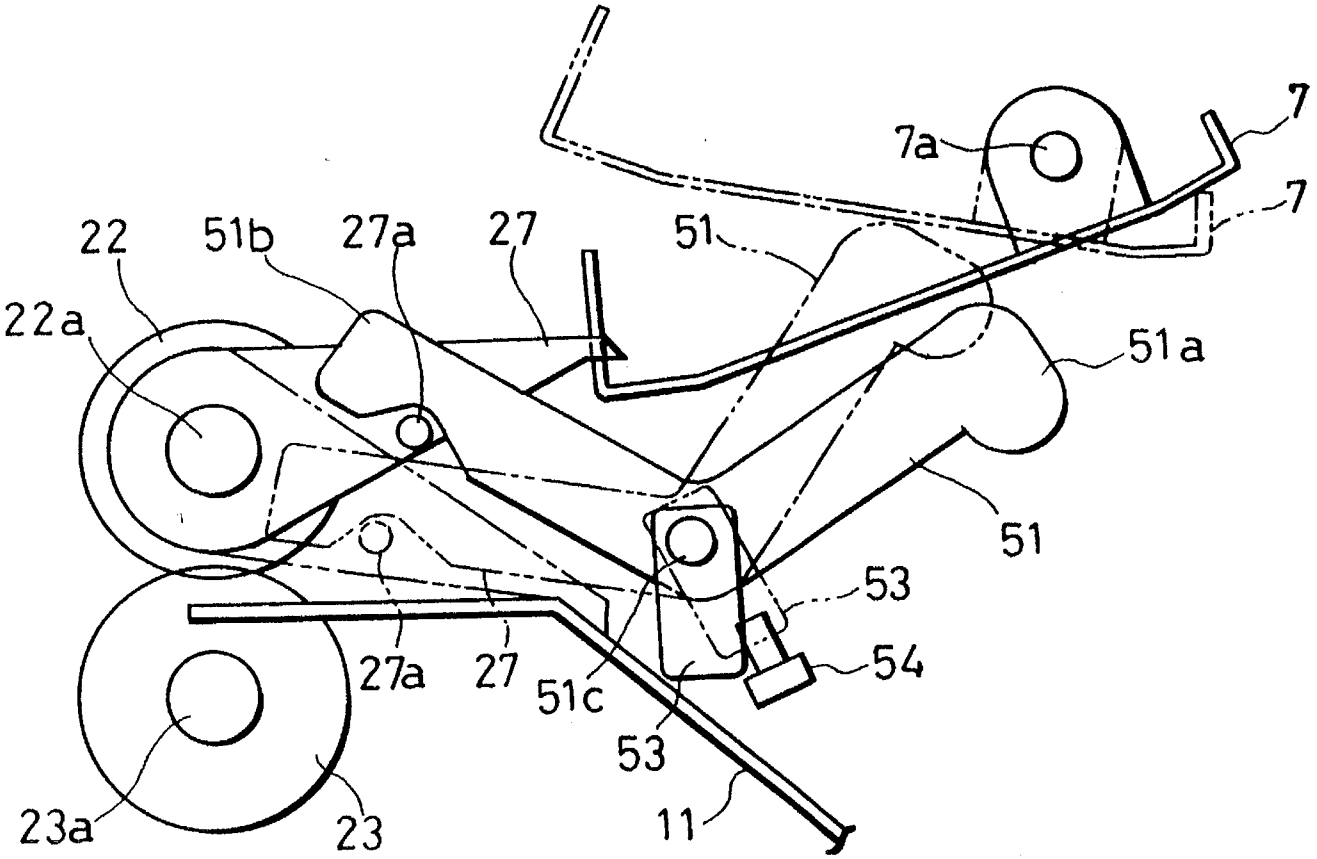
Figure 29:
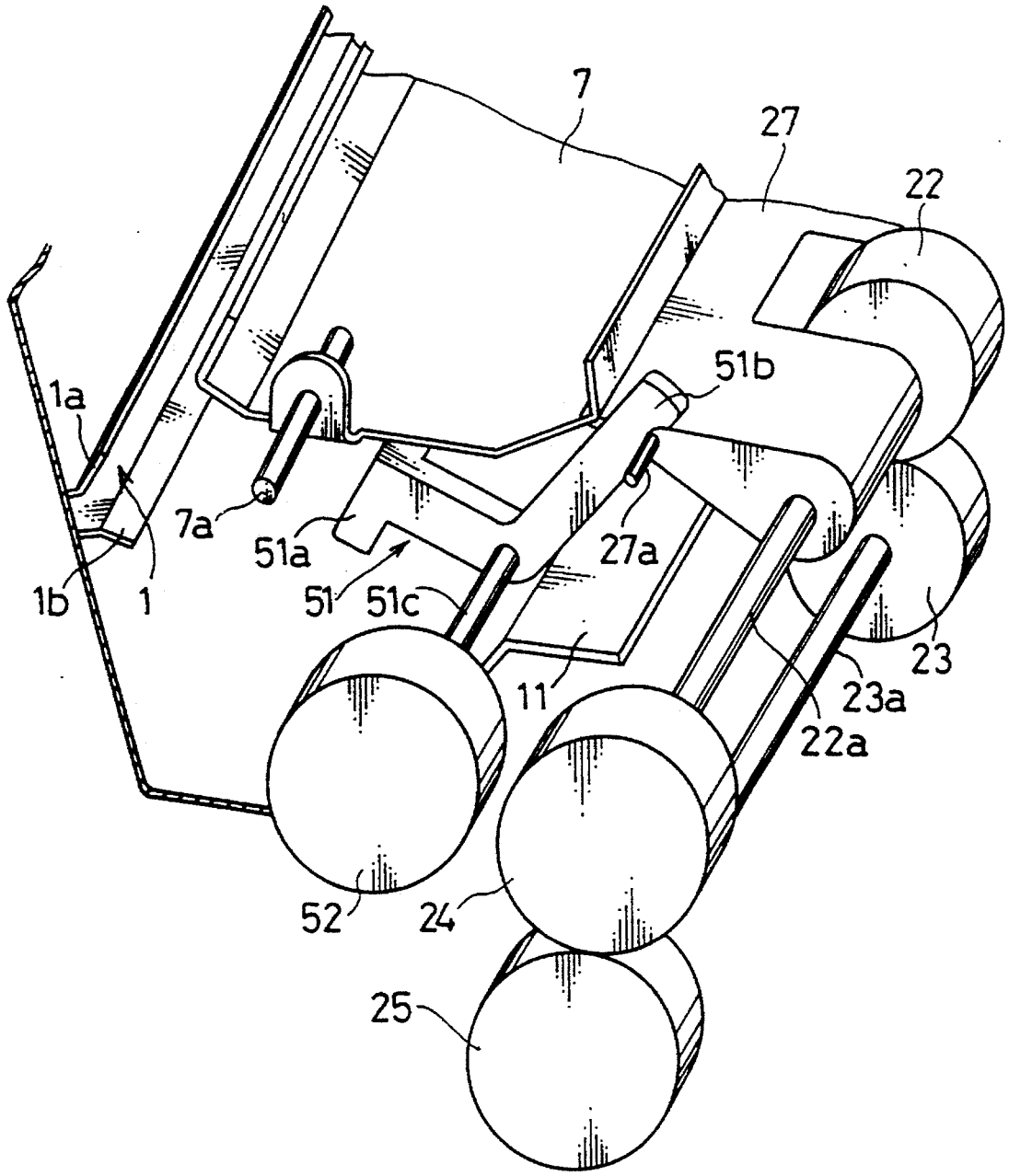
Figure 30:
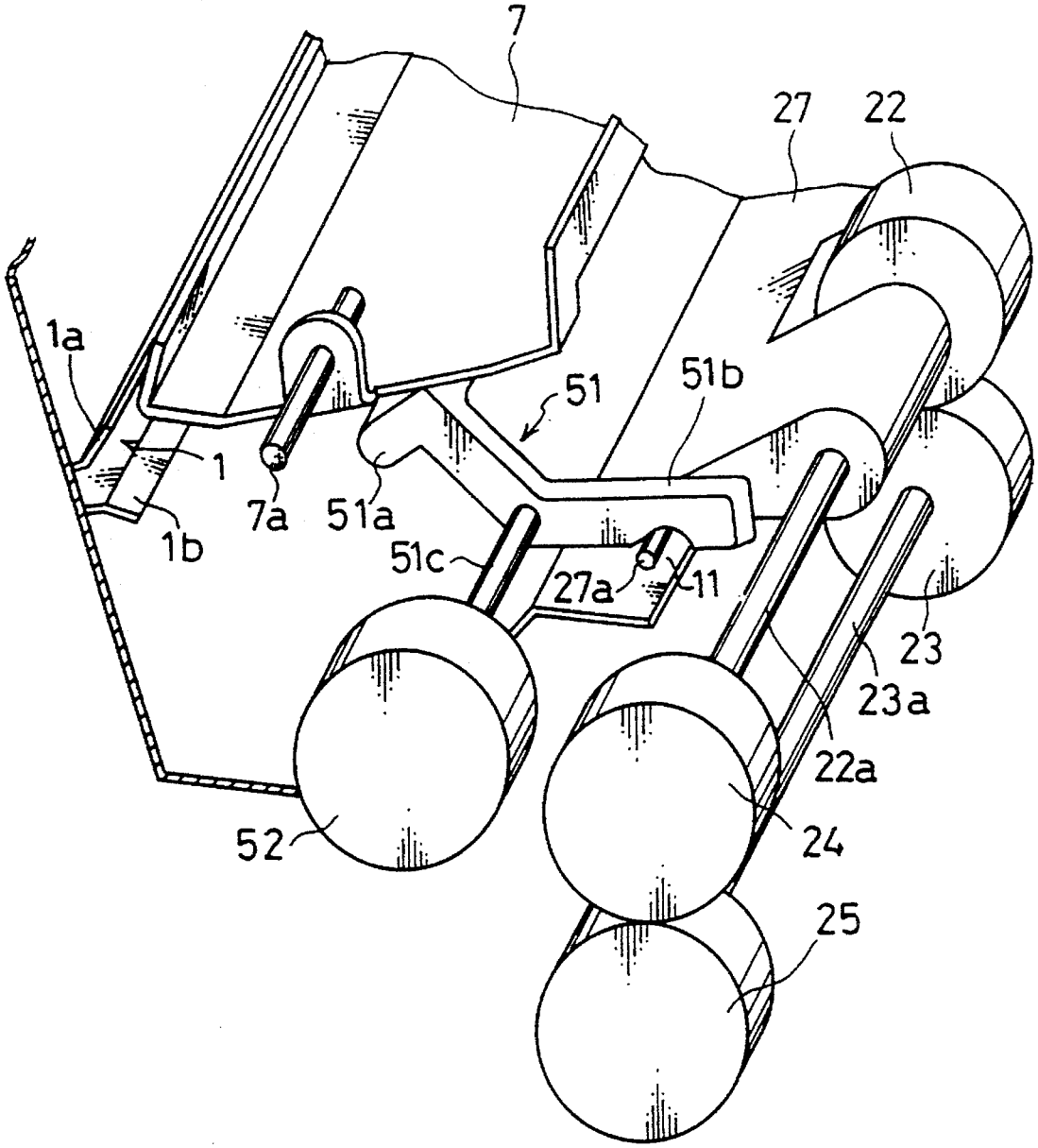

A sheet post-processing apparatus of the present embodiment is arranged so as to integrally move the movable sheet guide 7 and the gate 27 by means of a single motor. Namely, as shown in FIG. 28 through FIG. 30, the movable sheet guide 7 is supported by a shaft 7*a* so as to be freely rotatable, and the gate 27 is provided so as to be freely rotatable with respect to a roller shaft 22*a* of the upper discharge roller 22. The upper discharge motor 24 is connected to the roller shaft 22*a*, and the lower discharge motor 25 is connected to the roller shaft 23*a* of the lower discharge roller 23.

The movable sheet guide 7 and the gate 27 are supported by a stopper for controlling the above movement and force exerting means such as a spring (not shown). The movable sheet guide 7 and the gate 27 are set in respective non-staple mode positions shown by a solid line in FIG. 28 as home positions. Additionally, an arm 51 in almost V-shape is provided between the movable sheet guide 7 and the gate 27 as a drive member. The arm 51 is arranged such that one extended portion 51*a* is made in contact with the lower surface of the movable sheet guide 7, and the other extended portion 51*b* mates with a pin 27*a* which is projected out of the gate 27 from the upper side. As shown in FIG. 29, an arm shaft 51*c* as the rotation center of the arm 51 is connected to the guide gate switching motor 52 composed of a stepping motor as drive member drive means, and the guide gate switching motor 52 rotates the arm 51, and the movable sheet guide 7 and the gate 27 move from the non-staple mode position shown in FIG. 29 to the staple mode position shown in FIG. 30 or vice versa. Moreover, the sensor detecting plate 53 is provided onto the arm 51, and by an optical arm position sensor 54 for detecting the sensor detecting plate 53, the position of the arm 51, i.e., the respective positions of the movable sheet guide 7 and the gate 27 are detected.

Figure 31:
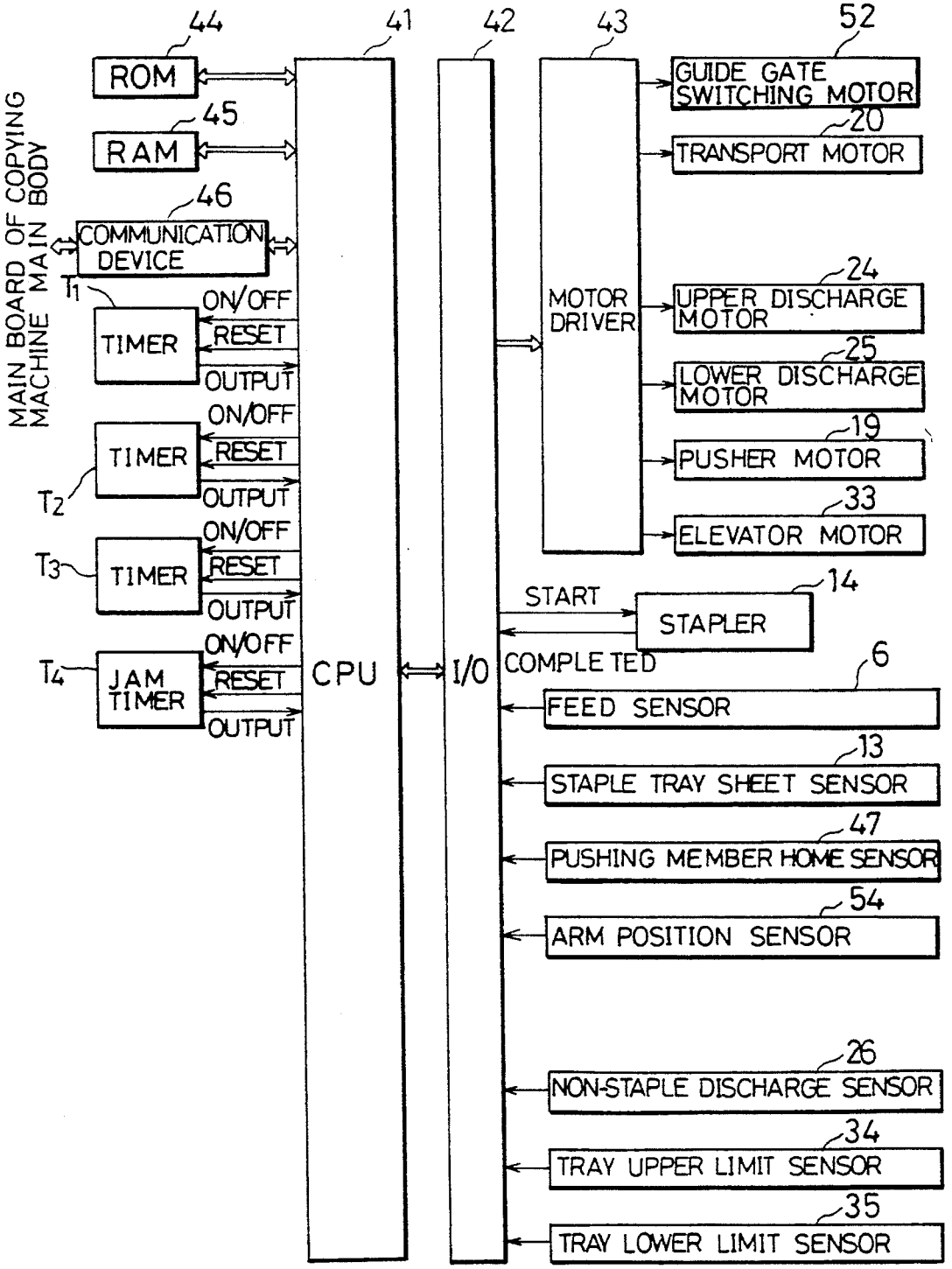
Figure 32:
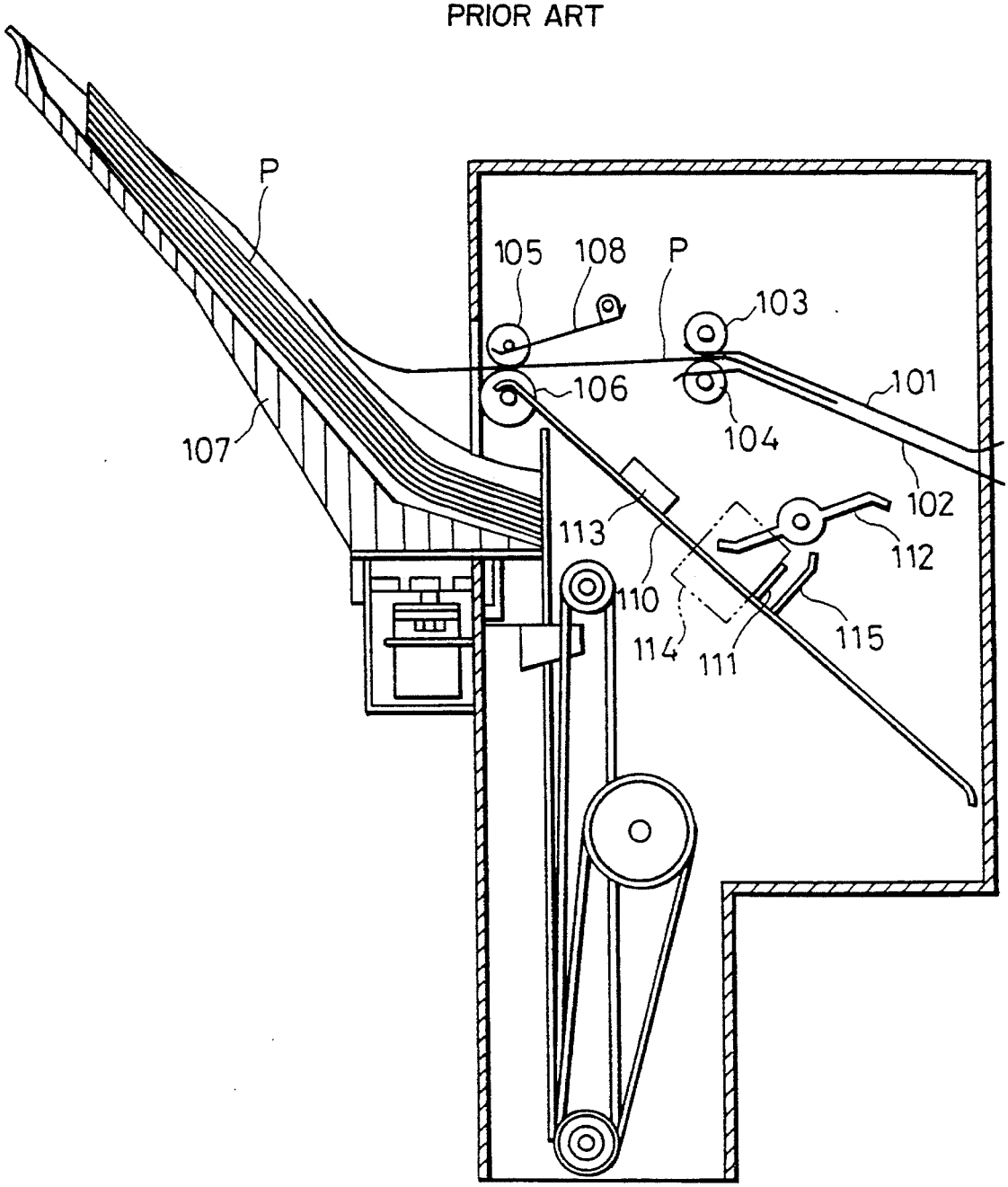
FIG. 32 PRIOR ART
FIG. 32 is a front view showing a schematic configuration of a conventional, prior art sheet post-processing apparatus showing operations in the non-staple mode.
Figure 33:
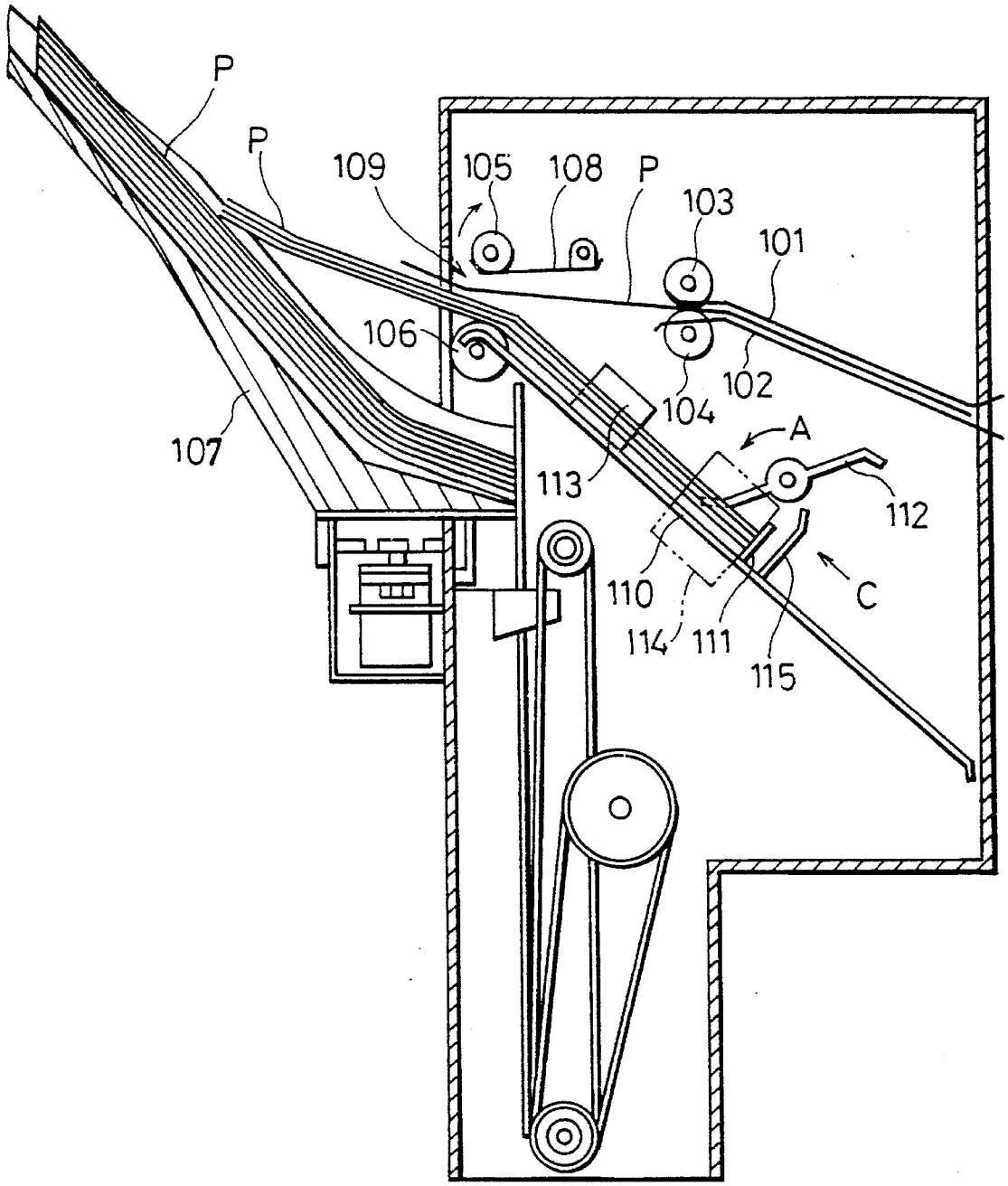
FIG. 33 PRIOR ART
FIG. 33 is a front view showing a schematic configuration of the conventional, prior art sheet post-processing apparatus of FIG. 32 showing operations in the staple mode.

As shown in FIG. 31, the sheet post-processing apparatus of the present embodiment is provided with a guide gate switching motor 52 in replace of the sheet guide displacement motor 8 and the gate switching motor 28 in the arrangement shown in FIG. 6 and is also provided with an arm position sensor 54 in replace of the gate home sensor 48 and the guide position sensor 36. The CPU 41, the ROM 44 and the arm position sensor 54 constitute control means.

As describe, the sheet post-processing apparatus of the present embodiment is arranged such that the arm 51 is driven by the guide gate switching motor 52, and the movable sheet guide 7 and the gate 27 are driven by the arm 51. Namely, the movable sheet guide 7 and the gate 27 are driven by means of a single motor, the configuration of the sheet post-processing apparatus of the present embodiment can be made simplified compared with that of the first embodiment, and a manufacturing cost can be reduced.

Moreover, the movable sheet guide 7 and the gate 27 are moved to the respective positions of the same mode, i.e., either the staple mode positions or the non-staple mode positions. Therefore, sheet jamming by being caught by either one of the movable sheet guide 7 or the gate 27 can be prevented, which may occur due to the difference in the standby positions of the movable sheet guide 7 and the gate 27.

In the above preferred embodiments, the respective sheet post-processing apparatuses have been discussed through the stapling process. However, the post-processing process of the present invention is not limited to the stapling process. Other than the above, the sheet post-processing apparatus of the present invention may be arranged so as to carry out punching by a puncher provided on the staple tray 11, gluing by a gluing device or folding by a sheet folder, etc.

The invention being thus described, it will be obvious that the same way be varied in many ways. Such variations are not to be regarded as a departure from the spirit and scope of the invention, and all such modifications as would be obvious to one skilled in the art are intended to be included within the scope of the following claims.

What is claimed is:

1. A sheet post-processing apparatus, comprising:

sheet transport means for transporting sheets from an external section into said apparatus;

a processing tray for placing thereon sheets to be processed;

a stacking tray for placing thereon sheets discharged from said apparatus;

sheet processing means for processing sheets placed on said processing tray;

first discharge means for discharging onto said stacking tray a set of sheets processed by said sheet processing means through a processed set discharge section;

second discharge means including a pair of upper and lower discharge rollers in contact with one another at a constant pressure in both a processing and non-processing mode, for discharging sheets onto said stacking tray, said second discharge means being provided at a portion on a sheet discharge side of said stacking tray;

a sheet guide member for guiding leading edges of the sheets transported by said sheet transport means to the processed set discharge section, said sheet guide member being capable of selectively moving between a processing mode position for dropping the sheets onto said processing tray and a non-processing mode position for guiding the leading edges of the sheets to the second discharge means, the sheets in the non-processing mode passing between the upper and lower discharge roller and in the processing mode passing through the processed set discharge section vertically above the upper discharge roller, said sheet guide member forming an opening of the processed set discharge section vertically above said second discharge means when said sheet guide member is moved to the processing mode position;

sheet guide member drive means for driving the sheet guide member; and control means for controlling said sheet guide member drive means such that said sheet guide member is placed in the processing mode position when the processing mode is selected, while in the non-processing mode position when the non-processing mode is selected.

2. The sheet post-processing apparatus as set forth in claim 1, wherein:

said sheet transport means includes a pair of transport rollers and transport roller drive means for driving said pair of transport rollers, and a relative position of said pair of transport rollers is set such that sheets are conveyed by said pair of transport rollers along said sheet guide member.

3. The sheet post-processing apparatus as set forth in claim 2, wherein:

one of said pair of transport rollers is provided at a position displaced from vertically above a center of the other one of said pair of transport rollers by a predetermined angle in an opposite side of said sheet guide member.

4. The sheet post-processing apparatus as set forth in claim 1, wherein:

said sheet transport means includes a pair of transport rollers and transport roller drive means for driving said pair of transport rollers, and said pair of transport rollers forms a buckled portion of the sheet from a leading edge to a trailing edge in a widthwise direction orthogonal to a sheet conveyance direction.

5. The sheet post-processing apparatus as set forth in claim 4, wherein:

said pair of transport rollers is provided in a widthwise direction of the sheet with a predetermined interval between them.

6. The sheet post-processing apparatus as set forth in claim 4, wherein:

said pair of transport rollers is provided so as to face one another, and a member of large diameter is formed on one peripheral portion of one of said pair of transport rollers, said member of large diameter being projected to one side of the other transport roller.

7. The sheet post-processing apparatus as set forth in claim 4, wherein:

said pair of transport rollers is provided so as to face one another, and members of large diameter are formed on both peripheral portions of one of said pair of transport rollers, said members of large diameter being projected to both sides of the other transport roller.

8. The sheet post-processing apparatus as set forth in claim 1, further comprising:

sheet entry detection means for detecting a state of the sheets transported by said sheet transport means; and sheet entry completion detection means for detecting that a sheet transportation by said sheet transport means is completed, wherein said processing tray is inclined in a direction where a sheet positioning member is placed at a lower position thereof;

said second discharge means provided at a higher position of said processing tray includes drive means for driving said pair of upper and lower discharge rollers;

said control means controls said upper discharge roller drive means such that said upper discharge roller rotates in a positive direction for discharging a sheet between said upper and lower discharge rollers onto said stacking tray when discharging the sheet in the non-processing mode, while in the processing mode, said control means controls said upper discharge roller drive means such that said upper discharge roller rotates in a reversing direction when said sheet entry detection means detects a sheet transported by said sheet transport means and rotates in the positive direction when said sheet entry completion detection means detects that a sheet transportation by the sheet transport means is completed, and that said upper discharge roller rotates in the reversing direction when discharging the sheets by said first discharge means.

9. The sheet post-processing apparatus as set forth in claim 8, wherein:

said control means controls said upper discharge roller drive means such that said upper discharge roller continuously rotates in the positive direction from when a first sheet is placed on said processing tray until said sheet entry completion detection means detects that the sheet transportation by said sheet transport means is completed.

10. The sheet post-processing apparatus as set forth in claim 8, wherein:

said control means controls said upper discharge roller drive means so as to stop positive rotation of said upper discharge roller when weight of sheets stacked on said processing tray reaches a predetermined value under the condition that said sheet entry completion detection means detects that the sheet transportation by said sheet transport means is completed.

11. The sheet post-processing apparatus as set forth in claim 1, further comprising:

a static electricity removing member provided so as to be capable of selectively moving between a static electricity removing position for sheets to be processed and discharged from the processed set discharge section by said first discharge means and a static electricity removing position for sheets not to be processed and to be discharged by said second discharge means; and static electricity removing member position change means for changing a position of said static electricity removing member, wherein said control means controls said static electricity removing member position change means such that said static electricity removing member is set in the static electricity removing position for sheets to be processed in the processing mode, while in the static electricity removing position for sheets not to be processed in the non-processing mode.

12. The sheet post-processing apparatus as set forth in claim 1, further comprising:

sheet entry completion detection means for detecting that a sheet transportation by said sheet transport means is completed, wherein said control means controls said sheet guide member drive means so as to move back to said sheet guide member to the processing mode position when said sheet guide member position is changed from the processing mode position to the non-processing mode position after said sheet entry completion detection means detects that the sheet transportation is completed.

13. The sheet post-processing apparatus as set forth in claim 1, further comprising:

sheet entry completion detection means for detecting that a sheet transportation by said sheet transport means is completed, wherein said control means controls said sheet guide member drive means so as to push sheets transported into said apparatus toward said processing tray in the processing mode after said sheet entry completion detection means detects that the sheet transportation is completed.

14. The sheet post-processing apparatus as set forth in claim 1, wherein:

said sheet guide member is provided with discharge failure detection means for detecting a discharge failure due to an upward buckling of sheets stacked on said processing tray when discharging the sheets by said first discharge means.

15. The sheet post-processing apparatus as set forth in claim 1, wherein:

said control means controls said sheet guide member drive means so as to move said sheet guide member to a position for controlling an upward buckling of the sheets stacked on said processing tray when discharging the sheets by said first discharge means.

16. The sheet post-processing apparatus as set forth in claim 15, wherein:

said sheet guide member is provided with discharge failure detection means for detecting a discharge failure due to an upward buckling of sheets stacked on said processing tray when discharging the sheets by said first discharge means.

17. The sheet post-processing apparatus as set forth in claim 1, further comprising:

sheet guide member displacement detection means for detecting a displacement of said sheet guide member by being pushed by a buckled sheet.

18. The sheet post-processing apparatus as set forth in claim 1, wherein:

said second discharge means includes upper and lower discharge roller drive means for respectively driving said pair of upper and lower discharge rollers, and said control means controls said lower discharge roller drive means so as to rotate said lower discharge roller only during a discharging movement of the sheets onto said stacking tray.

19. A sheet post-processing apparatus, comprising:

sheet transport means for transporting sheets from an external section into said apparatus;

a processing tray for placing thereon sheets to be processed;

a stacking tray for placing thereon sheets discharged from said apparatus;

sheet processing means for processing sheets stacked on said processing tray;

first discharge means for discharging onto said stacking tray a set of sheets processed by said sheet processing means through a processed set discharge section, second discharge means for discharging sheets onto said stacking tray, said second discharge means being provided at a portion on a sheet discharge side of said processing tray;

a first guide member provided along a sheet transport path extending from said sheet transport means to said second discharge means, said first guide member being capable of selectively moving between a processing mode position for guiding leading edges of sheets transported by said sheet transport means to the processed set discharge section so as to drop the sheets onto said processing tray and a non-processing mode position for guiding the leading edges of the sheets to said second discharge means, said first guide member forming an opening of the processed set discharge section vertically above said second discharge means when said first guide member is moved to the processing mode position;

a second guide member provided on a side of said second discharge means, said second guide member being capable of selectively moving between a non-processing mode position for guiding sheets to said second discharge means together with said first guide member in the non-processing mode position and a processing mode position for guiding sheets discharged by said first discharge means to the processed set discharge section;

a drive member which mates with both said first guide member and said second guide member and which selectively moves said first guide member and. Said second guide member between respective processing mode positions and non-processing mode positions;

drive member drive means for driving said drive member; and control means for controlling said drive member drive means so that said first and second guide members are placed at the respective processing mode positions in the processing mode, while said first and second guide members are placed in the respective non-processing mode positions in the non-processing mode.

20. A sheet post-processing apparatus, comprising:

sheet transport means for transporting sheets from an external section into said apparatus;

a processing tray for placing thereon sheets to be processed, said processing tray being included in a direction where a sheet positioning member is placed at a lower position of an inclined face thereof;

a stacking tray for placing thereon sheets discharged from said apparatus;

sheet processing means for processing sheets set at a predetermined position on said processing tray by said sheet positioning member;

first discharge means for discharging onto said stacking tray a set of sheets on said processing tray processed by said sheet processing means;

second discharge means for discharging sheets onto said stacking tray, said second discharge means being provided at an upper position of said processing tray on a sheet discharge side;

a first guide member provided along a sheet transport path extending from said sheet transport means to said second discharge means, said first guide member being capable of selectively moving between a processing mode position for guiding leading edges of sheets transported by said sheet transport means to the processed set discharge section so as to drop the sheets onto said processing tray and a non-processing mode position for guiding the leading edges of the sheets to said second discharge means, said first guide member forming an opening of the processed set discharge section vertically above said second discharge means when said first guide member is moved to the processing mode position;

a second guide member provided on a side of said second discharge means, said second guide member being capable of selectively moving between a non-processing mode position for guiding sheets to said second discharge means together with said first guide member in the non-processing mode position and a processing mode position for guiding sheets discharged by said first discharge means to the processed set discharge section in contact with said processing tray;

first guide member drive means for driving said first guide member;

second guide member drive means for driving said second guide member, and control means for controlling said first and second guide member drive means such that said first and second guide members are set in the respective processing mode positions in the processing mode, while said first and second guide members are set in the respective non-processing mode positions in the non-processing mode, and for controlling in the processing mode said second guide member drive means such that at least when a sheet is fed onto said processing tray by said sheet transport means, said second guide member vibrates so that said processing tray resonates.

* * * * *